US005435906A

United States Patent [19]

Johnson et al.

[11] Patent Number: 5,435,906

[45] Date of Patent: Jul. 25, 1995

[54] PROCESS FOR CATALYTICALLY CRACKING FEEDSTOCKS PARAFFIN RICH COMPRISING HIGH AND LOW CONCARBON COMPONENTS

[75] Inventors: Axel R. Johnson, North Babylon, N.Y.; Joseph L. Ross, Dallas; Atulya V. Saraf, Katy, both of Tex.

[73] Assignee: Stone & Webster Engineering Corporation, Boston, Mass.

[21] Appl. No.: 104,178

[22] Filed: Aug. 9, 1993

Related U.S. Application Data

[63] Continuation-in-part of Ser. No. 932,987, Aug. 20, 1992, abandoned.

[51] Int. Cl.[6] ..... C01G 51/06

[52] U.S. Cl. ..... 208/78; 208/80; 208/113; 208/155

[58] Field of Search ..... 208/78, 80, 113, 155

[56] References Cited

U.S. PATENT DOCUMENTS

| | | | |
|---|---|---|---|
| 2,900,325 | 8/1959 | Rice et al. | 208/78 |
| 3,424,672 | 1/1969 | Mitchell | 208/164 |
| 3,448,037 | 6/1969 | Bunn, Jr. et al. | 208/164 |
| 3,617,496 | 11/1971 | Bryson et al. | 208/80 |
| 3,751,359 | 8/1973 | Bunn, Jr. | 208/155 |
| 3,791,962 | 2/1974 | Demmel et al. | 208/80 |
| 3,799,864 | 3/1974 | Bunn, Jr. et al. | 208/80 |
| 3,801,493 | 4/1974 | Youngblood et al. | 208/78 |
| 3,886,060 | 5/1975 | Owen | 208/120 |
| 3,894,935 | 7/1975 | Owen | 208/78 |
| 3,928,172 | 12/1975 | Davis, Jr. et al. | 208/77 |
| 3,993,556 | 11/1976 | Reynolds et al. | 208/75 |
| 4,061,562 | 12/1977 | McKinney et al. | 208/61 |
| 4,116,814 | 9/1978 | Zahner | 208/78 |
| 4,331,533 | 5/1982 | Dean et al. | 208/113 |
| 4,332,674 | 6/1982 | Dean et al. | 208/120 |
| 4,336,160 | 6/1982 | Dean et al. | 502/42 |
| 4,388,176 | 6/1983 | Pratt et al. | 208/80 |
| 4,434,049 | 2/1984 | Dean et al. | 208/153 |
| 4,601,814 | 7/1986 | Mauleon et al. | 208/113 |
| 4,664,778 | 5/1987 | Reinkemeyer | 208/113 |
| 4,786,400 | 11/1988 | Farnsworth | 208/80 |
| 4,814,067 | 3/1989 | Gartside et al. | 208/127 |
| 5,009,769 | 4/1991 | Goelzer | 208/113 |
| 5,087,349 | 2/1992 | Goelzer et al. | 208/113 |

FOREIGN PATENT DOCUMENTS

| | | | |
|---|---|---|---|
| 2502897 | 7/1976 | Germany | C01G 11/02 |

*Primary Examiner*—Asok Pal
*Assistant Examiner*—Walter D. Griffin
*Attorney, Agent, or Firm*—Hedman, Gibson & Costigan

[57] ABSTRACT

A process for contemporaneously catalytically cracking a paraffin rich feedstock and a heavy feedstock wherein the feedstocks are segregated prior to catalytic cracking in separate reactors with regenerated particulate catalyst solids. The process provides for the separate optimal cracking of paraffinic constituents and heavy naphthenic constituents while maintaining an overall heat balance.

23 Claims, 12 Drawing Sheets

RATE CONSTANTS IN FCC
(DATA FROM WHITE, ARCO)
K/WHSV, 1/h
1.8
1.7
1.6
1.5
1.4
1.3
1.2
1.1
1
0.8
0.7
0.6
0.5
0.4
0.3
0.2
0.1
0
n-PARAFFIN
i-PARAFFIN
MONCYCPARF
POLCYCPARF
MONCYCAROM
POLCYCAROM
COMPOUND TYPES
FIRST-ORDER WEIGHT CONSTANTS, K/WHSV, H⁻¹ FOR COMPOUNDS (CALCULATED
FROM DATA IN FIGURE 7)(SURFACE AREA ASSUMED TO BE
100 M²/g)

PROCESS FOR CATALYTICALLY CRACKING FEEDSTOCKS PARAFFIN RICH COMPRISING HIGH AND LOW CONCARBON COMPONENTS

This application is a continuation-in-part of U.S. patent application Ser. No. 07/932,987, filed Aug. 20, 1992, now abandoned.

FIELD OF THE INVENTION

The present invention relates to the field of fluidized catalytic cracking of hydrocarbon feedstocks. In particular, this invention relates to an improved process and apparatus for catalytically cracking paraffin rich hydrocarbon feedstocks in combination with residual oils having significant asphaltene content as indicated by higher levels of Conradson Carbon utilizing a catalyst regeneration system and where feedstock components are segregated and selectively cracked to obtain improved yields.

BACKGROUND OF THE INVENTION

Refinery planning and feedstock allocation continues to be a very complex problem which must be addressed by petroleum refiners. Uncertainty in feedstock availability, price, and quality has driven the industry to seek flexible primary processing units such as the Fluid Catalytic Cracker (FCC). These have been favored because of their ability to be designed for various operations including maximum distillate, maximum gasoline, and maximum olefins production over a broad spectrum of feedstocks.

Further, many refiners wish to design for a broad slate of feedstocks in order to exploit spot purchases of distressed feedstocks. Feeds of economic opportunity are often heavy and require a specialized FCC to provide a profitable product slate. The optimum selection of feedstocks and the prediction of product yields will be shown to require more complex characterization than simple macroscopic properties such as API (American Petroleum Institute) gravity, carbon residue (Conradson Carbon or Ramsbottom), hydrogen content, etc. Proper consideration must also be given to the processing of paraffinic compounds in the presence of highly contaminated feedstocks with respect to catalytic cracking selectivity and economics of feedstock blends.

To understand the specific issues involved in the FCC processing of paraffinic, high CCR feedstocks consideration should be given to the chemical nature of FCC feeds. Petroleum is primarily a mixture of hydrocarbons together with lesser quantities of other compounds containing sulfur, nitrogen, oxygen and certain metallic elements such as nickel and vanadium. The fractions normally employed as feedstocks to FCC are the materials boiling above about 650° F. These fractions are very complex mixtures, however, for convenience, the United States Bureau of Mines has developed a classification system under which the hydrocarbon portions have been characterized as "paraffinic", naphthenic or asphaltic. Within the vacuum gas oil range (approximately 760° F. boiling point) the stocks are characterized as follows:

Paraffinic ≧ 30° API approximately K ≧ 12.2

Intermediate 20°-30° API approximately K = 11.5-12.2

Naphthenic ≧ 20° API approximately K ≧ 11.4 where K = characterization factor = $(T)^{\frac{1}{3}}/G$ when T = mean average boiling point degree Rankine and G = specific gravity at 60° F.

Vacuum gas oils derived from various crude oils exhibit a broad range of variation when measured against these criteria. As the following tabulation illustrates:

TABLE I

| | | VGO Properties | | | |
|---|---|---|---|---|---|
| Crude | Origin | Boiling Range °F. | Gravity °API | K | Description |
| Arabian Light | Saudi Arabia | 650–1050 | 22.9 | 11.9 | Intermediate |
| Kuwait | Kuwait | 680–1000 | 21.4 | 11.8 | Intermediate |
| Brent | North Sea | 660–1020 | 26.1 | 12.1 | Intermediate |
| Brega | Libya | 650–1050 | 27.7 | 12.3 | Paraffinic |
| Cirita | Indonesia | 650–1050 | 34.7 | 12.8 | Paraffinic |
| Shengli | China | 660–1050 | 26.5 | 12.2 | Paraffinic |
| Taching | China | 635–930 | 34.0 | 12.4 | Paraffinic |
| Isthmus | Mexico | 650–1000 | 19.7 | 11.6 | Intermediate |
| Bombay High | India | 700–1020 | 29.9 | 12.5 | Paraffinic |
| West Texas Light | United States | 600–1000 | 29 | 12.2 | Paraffinic |
| East Texas | United States | 600–1000 | 27 | 12.1 | Intermediate |
| Oklahoma | United States | 490–945 | 31.5 | 12.1 | Intermediate |

The range of feedstock compositions can further be illustrated by FIG. 6. This data shows the paraffin content of various vacuum gas oils as ranging from 28% (Light Arab) to over 60% (Bombay High). The following Table II is illustrative with respect to atmospheric residual oils (vacuum gas oil plus vacuum bottoms). Assay and mass spectrographic data are presented for Light Arab and Minas atmospheric residues as well as hydrotreated Middle East atmospheric residue. The major differences between the virgin Light Arab and Minas stocks are first in paraffin content and second in the higher level of monoaromatics, in the case of Light Arab. The hydrotreated stock shows that, although after hydrotreating the Middle East stock has an API gravity and CCR similar to Minas, its composition shows that its structure still affects its origin by being similar to Light Arab. The changes are essentially due to boiling range shifts which occur in hydroprocessing.

TABLE II

| COMPARISON OF ATMOSPHERIC RESIDUE | | | |
|---|---|---|---|
| | Light Arab ATB | Minas ATB | H/T Middle East ATB |
| Gravity, °API | 17.3 | 26.7 | 25.1 |
| CCR, wt % | 9.8 | 4.9 | 3.0 |
| Hydrogen, wt % | 12.06 | 13.3 | 12.5 |
| Mass Spectrographic Analysis | | | |
| Paraffins | 20.6 | 34.5 | 25.0 |
| Cycloparaffins | 40.1 | 39.0 | 36.5 |
| Total Paraffins | 60.7 | 73.5 | 61.5 |

TABLE II-continued

| COMPARISON OF ATMOSPHERIC RESIDUE | Light Arab ATB | Minas ATB | H/T Middle East ATB |
|---|---|---|---|
| Alkyl Benzenes | 8.3 | 2.3 | 9.8 |
| Benzo-Cyclo Paraffins | 6.9 | 2.9 | 8.8 |
| Total Mono Aromatics | 15.2 | 5.2 | 18.6 |
| Diaromatics | 10.6 | 8.1 | 7.3 |
| Triaromatics & Hur | 13.5 | 13.2 | 12.6 |
| Total Cord | 24.1 | 21.3 | 19.9 |
| Aromatics & Hur Total | 100.0 | 100.0 | 100.0 |

Several investigators have studied the relative reaction rates of the various hydrocarbon compounds under catalytic cracking conditions and have developed information useful information to an understanding of our observations and invention.

FIG. 7 shows the FCC conversion of various classes of compounds as a function of severity. This work was done by using amorphous catalyst containing no zeolites. The low reaction rate for normal paraffins on this type of catalyst is quite apparent. At a severity of 1.0, there is still approximately 70% unconverted 430° F.+material as compared with 30% or less for the cycloparaffins and monocycloaromatics.

FIG. 8 tabulates FCC reaction rate constants for five different hydrocarbons ranging from normal paraffins through condensed cycloparaffins. For the amorphus catalyst used ($SiO_2$—$Al_2O_3$) the rate constants corroborate the ranking shown in FIG. 7. On the other hand, the data shown for a molecular sieve catalyst (REHX) shows first, a much higher reaction rate constant for normal paraffin than in the case of amorphous catalyst and second, a decreased relative reaction rate of condensed cycloparaffins relative to normal paraffins over this type of catalyst. This latter phenomenon is attributed to the greater difficulty for the condensed molecules to enter the zeolite pore structure as compared with the more linear molecules associated with normal paraffins.

Combination fluidized catalytic cracking (FCC)-regeneration processes wherein hydrocarbon feedstocks are contacted with a continuously regenerated freely moving finely divided particulate catalyst material under conditions promoting conversion into such useful products as olefins, fuel oils, gasoline and gasoline blending stocks are well known. Typical modern FCC units employ a riser reactor comprising a vertical cylindrical reactor in which regenerated feedstock are introduced at the bottom, travel up the riser, exit at the top and the catalyst is separated from the hydrocarbon after being in contact for a period of time from about 1–5 seconds.

FCC processes for the conversion of high boiling portions of crude oils comprising heavy vacuum gas oils, reduced crude oils, vacuum resids, atmospheric tower bottoms, topped crudes or simply heavy hydrocarbons and the like have been of much interest in recent years especially as demand has exceeded the availability of more easily cracked light hydrocarbon feedstocks. The cracking of such heavy hydrocarbon feedstocks, many of which are rich in asphaltenes (as evidenced by high Conradson Carbon), results in the deposition of relatively large amounts of coke on the catalyst during cracking. The coke produced by the asphaltenes typically deposit on the catalyst in the early stage of the reaction creating a condition where the cracking catalyst is contaminated by significant levels of coke during the entire reaction system.

A major problem associated with processing residual oil feedstocks, particularly those with high paraffins contents, is this higher tendency to deposit coke per unit mass of catalyst in the reactor riser, particularly at the early stages. This effect is indicated by delta coke which is measured by the difference in the weight percent coke on the catalyst before and after regeneration.

In the case of gas oil feedstocks having a negligible asphaltene content, the delta coke will increase due to coke produced during the catalytic cracking reactions from a negligible value to a value of from about 0.5 to 0.9 as the catalyst travels through the reactor. When processing heavier feedstocks with an appreciable asphaltene content, however, a significant delta coke value will exist immediately at the point of feed vaporization due to the inability to vaporize the heavy asphaltene molecules. In the reactor environment any unvaporized material will undergo thermal degradation which can be expected to yield a certain quantity of unvaporizable heavy hydrocarbon that will deposit on the catalyst. Typically, for example, a feed having a Conradson Carbon level of 5 wt % in which catalyst is circulating at a weight ratio of 5–7 parts catalyst to 1 part hydrocarbon will have an initial delta coke level of 0.4–0.8 and a final delta coke level of 0.8 to 1.3 or higher.

The value of delta coke indicates the degree of fouling the catalyst experiences in the reactor. A fouled catalyst has many of its zeolitic active sites blocked and only a portion of its matrix sites available thereby reducing its cracking activity and selectivity to desired products.

The prime reason for the higher delta coke values observed while processing residual oils is the presence of heavy asphaltene coke producing molecules in the feedstock. The concentration of these molecules is indicated by the value of Conradson Carbon Residue (CCR) associated with the feedstock. Hence, feedstocks with high CCR content will tend to produce high initial delta coke values. The bulk of the feed CCR is associated with the fraction boiling above 1050° F. and therefore, depending upon the size of this fraction, the process parameters for catalytically cracking the feedstock may change significantly from that employed for a typical gas oil.

Challenges with resid processing required new concepts to overcome the many problems associated with the heaviness of the feedstocks, including difficulties in atomizing and vaporizing resids, in reducing high coke yields in then conventional gas oil cracking systems, and in handling extensive heat removal problems due to the high coke yields. Proper catalyst selection was also found to be vital to control and minimize catalyst delta coke (coke yield/catalyst/oil ratio) which is recognized to be an essential catalyst effectiveness parameter.

At present, there are several processes available for fluidized catalytic cracking of such heavy hydrocarbon feedstocks which are known in the art. In such processes, a combination fluidized catalytic cracking-regeneration operation is provided.

Unique catalyst regeneration systems including single or two-stage regeneration systems with partial or full CO combustion are employed to provide the heat removal required when processing high CCR feeds. Also, catalyst coolers have been used to compensate for the high coke level of the catalyst being regenerated.

The hot regenerated catalyst is then employed in the high temperature reaction system to achieve highly selective catalytic cracking for conversion of both high and low boiling components contained in heavy hydrocarbon feeds.

The amount of carbon on the catalyst increases along the reaction path, reducing the number of active sites which can be used for cracking. With high CCR feeds, the coke make rapidly fouls the catalyst, reducing activity immediately upon feed injection. Although the reduced activity may not pose a serious problem to reaction of certain heavy feeds, the problem becomes more acute when the feedstock comprises a high CCR component and a paraffin component, either as separate components of one feed or a blend of multiple feeds.

The blocking of active sites is detrimental because it prevents the cracking of otherwise ideal feed components in an efficient and highly selective manner. This is especially evident when the feedstock contains a significant portion of straight chain paraffins. These paraffins have a high potential to convert to gasoline and lighter material but, as earlier explained, proceeds at a relatively low cracking rate. In the presence of a fouled catalyst and at normal reaction times these molecules do not convert to their full potential resulting in substandard product yields. This problem has little impact in gas oil cracking, but for residual oil cracking the problem is greatly intensified due to the significantly increased delta coke levels.

To illustrate this phenomenon data are presented below on several plant operations.

Plant A

This plant processes a wide variety of residual feedstocks containing gas oils which can be characterized as ranging from intermediate to paraffinic. Operations are typically on feeds having Conradson Carbon levels in the range of 2–5 wt %. Although it is difficult to develop a meaningful value of K for residual oils due to the inability to determine a realistic average boiling point, an approach to feedstock characterization can be developed by use of a gravity/Conradson Carbon relationship as a basis for analogy to known crudes. In FIG. 9, we have plotted three lines which characterize Arabian Light atmospheric residue/VGO in one case and similarly for Shengli and Taching in the others. These lines are developed by connecting the data points of the vacuum gas oil and the atmospheric residue. This gives a basis for selecting operating data based upon the similarity of feedstocks employed to typical residue containing intermediate and paraffinic gas oils. Referring to Table I, Light Arabian VGO has a K of 11.9, Shengli a value of 12.2 and Taching a value of 12.4.

Using this plot as a basis, a selection of data of similar bases was made from the operations of Plant A. FIG. 9 shows three groups of data:

1) A group (designated by the "+" symbol) has API/CCR relationships similar to Light Arabian and it can be inferred that the VGO portion of this feed would be characterized as intermediate (K~11.9–12).
2) A group (designated by the "•" symbol) has API/CCR relationships indicating that the VGO is somewhat more paraffinic than that found in Shengli crude with K ~12.2–12.3.
3) A considerably more paraffinic group (designated by the "□" symbol) is similar to Minas or Taching and the VGO fraction may have a K as high as 12.4.

In order to evaluate the conversion efficiency of an FCC operation, a useful parameter is the API gravity of the decant oil or fractionator bottoms streams. This stream essentially consists of the unconverted material boiling above the initial boiling point of the feedstock. Where this value is low (+1 or lower, down to negative values), the conversion of the bulk of the material contained in the feed which is capable of conversion has been converted. FIG. 10 presents data on the decant oil API as a function of delta coke for the three groups of data described above.

In the case of the data for the intermediate feed ("+" points), it is apparent that there is little influence of the delta coke level on the API gravity of the decant oil. However, the influence of delta coke on decant oil gravity is quite pronounced in the case of the data similar to Shengli ("•" points) and even more so for the most paraffinic feed ("□"] point).

Plant B

Plant B operates on a Mid Continent United States crude and FCC feed data for this unit is plotted on FIG. 9 with "B" symbols. These feeds, while lighter, are similar in relative character to the Plant A feeds which were moderately paraffinic ("•" symbol). When the Plant B data are then plotted in FIG. 10, they also show essentially the same delta coke/decant oil gravity relationship as the Plant A data.

Plant C

Plant C processes a fairly paraffinic feed (see point "C" on FIG. 9) and during an eight day period with generally constant feed quality varied feed preheat in operations over a range of catalyst-to-oil ratio which resulted in delta coke ranging from 1 to 1.7. FIG. 11 plots the yield of coke and decant oil (at constant temperature) against delta coke and illustrates the impact of delta coke on overall cracking efficiency.

Plant D

Plant D processes a hydrotreated Middle East residue (as shown in Table II). While on FIG. 9 this feed plots as if it were paraffinic, it was pointed out previously that the composition is closer to an intermediate feed. This is borne out by its operating data (point "D" on FIG. 10) which shows a low decant oil gravity (−2° API) at a high delta coke (1.3). This further illustrates that the paraffin content of the feed is the critical variable.

To achieve the desired product yields under normal reaction conditions, feeds comprising a high Concarbon component and hydrogen rich paraffins require operations designed to achieve a low delta coke, to provide the catalyst activity necessary to crack the paraffins, due to the slow reaction rate of paraffins. This is important since underconversion of the paraffins results in high decant oil yields with high API gravity values. The underconversion of the paraffin component is believed to occur at delta coke levels which exceed about 0.8 to 1.0 (with lower delta coke levels required when paraffin content exceeds 30–35%). This delta coke is created by both feed contaminants and as a normal consequence of the cracking reaction of the feedstocks.

To fully crack feedstocks in this situation, the paraffins must be cracked over a cleaner catalyst, that is, at lower delta coke levels. The known approach is to use a catalyst cooling device and to increase the catalyst-to-oil ratio and therefore lower delta coke. This, however, is not always effective since the delta coke may not be sufficiently reduced or the higher catalyst/oil ratio may overcrack some portions of the products. Further, the higher cat/oil ratio is inefficient in that more catalyst must be passed through the regeneration system resulting in a higher unused coke yield and reduced yields of valuable products.

A number of references relate to the processing of feedstocks having components favoring differing conditions for optimization. A method for optimizing cracking selectivity from relatively lower and higher boiling feeds is described in U.S. Pat. No. 3,617,496. In such a process, cracking selectivity to gasoline production is improved by fractionating the feed hydrocarbon into relatively lower and higher molecular weight fractions capable of being cracked to gasoline and charging said fractions to separate riser reactors. In this manner, the relatively light and heavy hydrocarbon feed fractions are cracked in separate risers in the absence of each other, permitting the operation of the lighter hydrocarbon riser under conditions favoring gasoline selectivity, e.g. eliminating heavy carbon laydown, convenient control of hydrocarbon feed residence times, and convenient control of the weight ratio of catalyst to hydrocarbon feed, thereby affecting variations in individual reactor temperatures.

Another example is seen in U.S. Pat. No. 5,009,769 which describes sending naphtas, boiling below about 450° F., to a first riser and gas oils and residual oils to a second riser.

Other processes which similarly employ the use of two or more separate riser reactors to crack dissimilar hydrocarbon feeds are described, for example, in U.S. Pat. No. 3,993,556 (cracking heavy and light gas oils in separate risers to obtain improved yields of naphtha at higher octane ratings); U.S. Pat. No. 3,928,172 (cracking a gas oil boiling range feed and heavy naphtha and/or virgin naphtha fraction in separate cracking zones to recover high volatility gasoline, high octane blending stock, light olefins for alkylation reactions and the like); U.S. Pat. No. 3,894,935 (catalytic cracking of heavy hydrocarbons, e.g. gas oil, residual material and the like, and a $C_3$–$C_4$ rich faction in separate conversion zones); U.S. Pat. No. 3,801,493 (cracking virgin gas oil, topped crude and the like, and slack wax in separate risers to recover, inter alia, a light cycle gas oil fraction for use in furnace oil and a high octane naphtha fraction suitable for use in motor fuel, respectively); U.S. Pat. No. 3,751,359 (cracking virgin gas oil and intermediate cycle gas oil recycle in separate respective feed and recycle risers); U.S. Pat. No. 3,448,037 (wherein a virgin gas oil and a cracked cycle gas oil, e.g. intermediate cycle gas oil, are individually cracked through separate elongated reaction zones to recover higher gasoline products); U.S. Pat. No. 3,424,672 (cracking topped crude and low octane light reformed gasoline in separate risers to increase gasoline boiling range product); and U.S. Pat. No. 2,900,325 (cracking a heavy gas oil, e.g. gas oils, residual oils and the like, in a first reaction zone, and cracking the same feed or a different feed, e.g. a cycle oil, in a second reaction zone operated under different conditions to produce high octane gasoline).

U.S. Pat. No. 3,791,962 segregates feedstock for feed into separate risers on the basis of an aromatic index and regeneration of the fouled catalyst from each riser in differing initial environments, dealing with the increased coke make of heavier components. In dealing with various coke makes, U.S. Pat. No. 3,791,962 also suggests that temperature affects the yield of carbon.

The prior art, however, does not deal with the issue of difficulty of conversion of paraffinic feeds over contaminated catalysts and, in particular, does not deal with fluidized catalytic cracking of a feedstock containing a significant resid oil fraction (i.e. over 10 vol. %) and a paraffin rich fraction in such a manner as to overcome the unexpected detrimental effects of the combination when each fraction can be optimally processed conventionally.

SUMMARY OF THE INVENTION

It is therefore an object of the present invention to provide an improved process for catalytically cracking hydrocarbon feedstocks comprising a paraffin rich fraction and a high Concarbon fraction in separate reactors utilizing catalyst regeneration.

It is a further object of this invention to provide a process wherein the reaction conditions applied to individual feedstocks are controlled to obtain a desired product distribution and improved yields of high octane gasoline blending stock and light olefins.

It is still another object of this invention to provide an improved process of catalytically cracking hydrocarbon feedstocks which relates catalyst activity and selectivity to processing parameters of individual heavy hydrocarbon material/paraffin rich fractions to improve the selective conversion thereof to gasolines and light olefins.

It is yet another object of the invention to provide a process wherein processing of the heavy hydrocarbon and paraffin fractions maintains an overall heat balance without the need for catalyst cooling.

To this end, the present invention provides an improved combination segregation-fluidized catalytic cracking-regeneration process for cracking a heavy feed of 4–16 wt % CCR contemporaneously with a paraffin rich feed comprising a hydrocarbon feed with a VGO portion having a K value of 12.2 or higher and a 0–6 wt % CCR, which may or may not contain a resid component, or vapors thereof, in a dual reactor system with a cracking catalyst regenerated in a catalyst regeneration system, where the cat/oil ratio is adjusted to maintain the delta coke at a level of 1.0 or less in the paraffin rich feed reactor.

It is understood that the present invention can be run in various reactors capable of carrying out short reaction time fluidized catalytic cracking, including but not limited to downflow and riser reactors. Although one or another type of reactor is mentioned in the following specification, the types of FCC reactors which may be employed to carry out the present invention are not so limited.

The process proceeds by first segregating the feeds to achieve a first feed flow comprising essentially paraffin rich residual or gas oils with a VGO portion having a K value of 12.2 or higher, and a second feed flow consisting essentially of higher CCR feeds.

Thereafter, regenerated catalyst from the catalytic regeneration system is charged with the first paraffin rich feed flow to the mix zone of a first reactor. The reaction zone operates at a temperature from about 920° F. to about 1200° F., a residence time of 0.1–3 seconds with a catalyst-to-oil ratio of from about 4:1 to about 6:1 as necessary to maintain the delta coke level at 1.0 or less, to generate a first product gas and entrained catalyst particles.

Catalyst, at least partially regenerated, from the catalyst regeneration system and the heavy resid feed are charged to the mix zone of a second reactor. The second reactor is operated at a temperature maintained from about 950° F. to about 1100° F., a residence time of 0.5–4 seconds with a catalyst-to-oil ratio of from about 8:1 to about 12:1, to generate a second product gas and entrained catalyst particles.

The product gases from both reactors and the entrained catalyst are separated and the product gases are sent to a fractional distillation tower to recover at least a gasoline boiling range material fraction, a lighter gaseous hydrocarbon material fraction, a light cycle oil boiling range material fraction and a higher boiling range material fraction.

The separated, coke laden catalyst particles are delivered to a stripping section to recover entrained hydrocarbon and then onto the catalyst regeneration system for regeneration and return of the catalyst to the mix zones of the riser reactors.

As a result, an improved conversion of 650° F. plus boiling range material is achieved and the heat balance between the reactors is sufficiently maintained to run the separate high and low CCR reactions without additional fuel input or the need for catalyst cooling during regeneration.

As will be appreciated by those skilled in the art, a major advantage provided by the present invention is the ability to operate the two reactors independently, providing the flexibility to simultaneously select operating conditions such as temperature, catalyst/oil ratio and residence time specifically suited to achieve the optimum desired conversion of a variety of combinations of high CCR and paraffin rich hydrocarbon feedstocks.

In particular, the novel arrangement of apparatus and processing concepts of this invention, as more fully discussed below, creates a synergy between the reaction of generally incompatible fractions to achieve improved yields of preferred product production. The first reactor operates with low coke yield running unconstrained by heat balance and the second reactor can operate well with higher delta coke due to a lower concentration of "hard to crack" paraffins.

Generally, the feed described as the paraffin rich feed comprises waxy atmospheric residues having generally low to moderate CCR values (less than about 6 wt % CCR) and waxy vacuum gas oils having boiling points of less than about 1050° F. with a VGO portion having a K value of 12.2 or greater. The feed herein described as the naphthenic, resid or heavy feed, contains a significant fraction which boils at over 1050° F. and contains levels of carbon residue (CCR) of from about 4 to about 16 wt % and metals, as well as limited amounts of paraffins. The feeds can be from separate sources and segregated as described or segregated by distillation from a naturally occurring or blended mixture of the fractions.

In cases employing segregation by distillation, it should be noted that although the preferred segregation between the heavy resids and paraffin rich fractions is at higher levels such as 1050° F., the fractions of a mixture can be separated at a lower temperature, down to about 950° F., to dilute the heavy feed for injection into the second reactor. Alternatively, a diluent such as LCO, heavy naphtha or a recycle stream is particularly beneficial to the process to provide feedstock properties for the resid feed (such as viscosity and surface tension) compatible with efficient feed injection.

During separation of the product gases from the entrained catalyst, one or separate cyclones or other separation devices can be used for each of the risers and the products can be combined in a vapor stream conduit wherein the combined stream is sent to a fractionation tower for quenching and separation. Alternatively, product vapors may be quenched either in the vapor stream conduit or immediately following separation from the catalyst.

In an alternative embodiment, the two reactors are connected at the downstream ends to form a reactor combined conduit prior to separation of the catalyst from the product gases. This arrangement provides for a synergistic effect between the risers reacting the paraffin rich and heavy resid fractions.

In this alternative embodiment, when the hotter paraffin rich stream having a residence time of 0.1 to 3 seconds and a reactor outlet temperature of about 920°–1200° F. contacts the cooler heavy resid stream having a residence time of from about 0.5–4 seconds and a reactor outlet temperature of about 950°–1100° F. in the reactor combined conduit, the resid stream quenches the reaction taking place in the paraffin rich stream to avoid overcracking due to continuing thermal or catalytic reactions. At the same time the cleaner (lower delta coke) catalyst from the paraffin rich stream is available to promote additional catalytic reaction of the heavy resid fraction prior to separation of the catalyst from the product gases for regeneration.

In another alternative, the heavy feed is passed through a reactor with a catalyst at a high temperature and short residence time to vaporize the heavy feed. Vaporization of the heavy feed is followed by separation of the hydrocarbons from the catalyst for injection of the vaporized hydrocarbons into the mix zone of the low CCR reactor with fresh catalyst and the low CCR feed. The catalyst from the low CCR feed can also be used in the high CCR reactor without prior regeneration.

In each embodiment, the coke laden catalyst having passed through the reactors is delivered to an external catalyst regeneration system where the coke is combusted in the presence of an oxidizing gas. The catalyst regeneration system can be of any known type, including a single stage regeneration zone or vessel, however, a preferred catalyst regeneration system comprises separate first and second catalyst regeneration zones.

In the preferred system, catalyst is continuously regenerated in said first and second regeneration zones, successively, by combusting hydrocarbonaceous deposits on the catalyst in the presence of an oxygen-containing gas under conditions effective to produce a first regeneration zone flue gas relatively rich in carbon monoxide and a second regeneration zone flue gas relatively rich in carbon dioxide, wherein temperatures in the first regeneration zone range from about 1100° F. to about 1300° F., and temperatures in the second regeneration zone range from about 1300° F. up to about 1600° F.

In an alternative embodiment, the catalyst for the separate riser reactors are taken from the separate regeneration zones. The partially regenerated catalyst from the first regeneration zone can be used in the heavy feed reactor where the heavy feed is not detrimentally affected by the partially coke laden catalyst. The fully regenerated catalyst from the second regeneration zone is used in the paraffin rich feed riser reactor. This alternative is attractive with certain feeds to reduce catalyst regeneration costs and demands.

The process and apparatus of the present invention will be better understood by reference to the following detailed discussion of specific embodiments and the attached FIGURES which illustrate and exemplify such embodiments. It is to be understood, however, that such illustrated embodiments are not intended to restrict the present invention, since many more modifications may be made within the scope of the claims without departing from the spirit thereof.

DETAILED DESCRIPTION OF SPECIFIC EMBODIMENTS OF THE INVENTION

Figure 1:
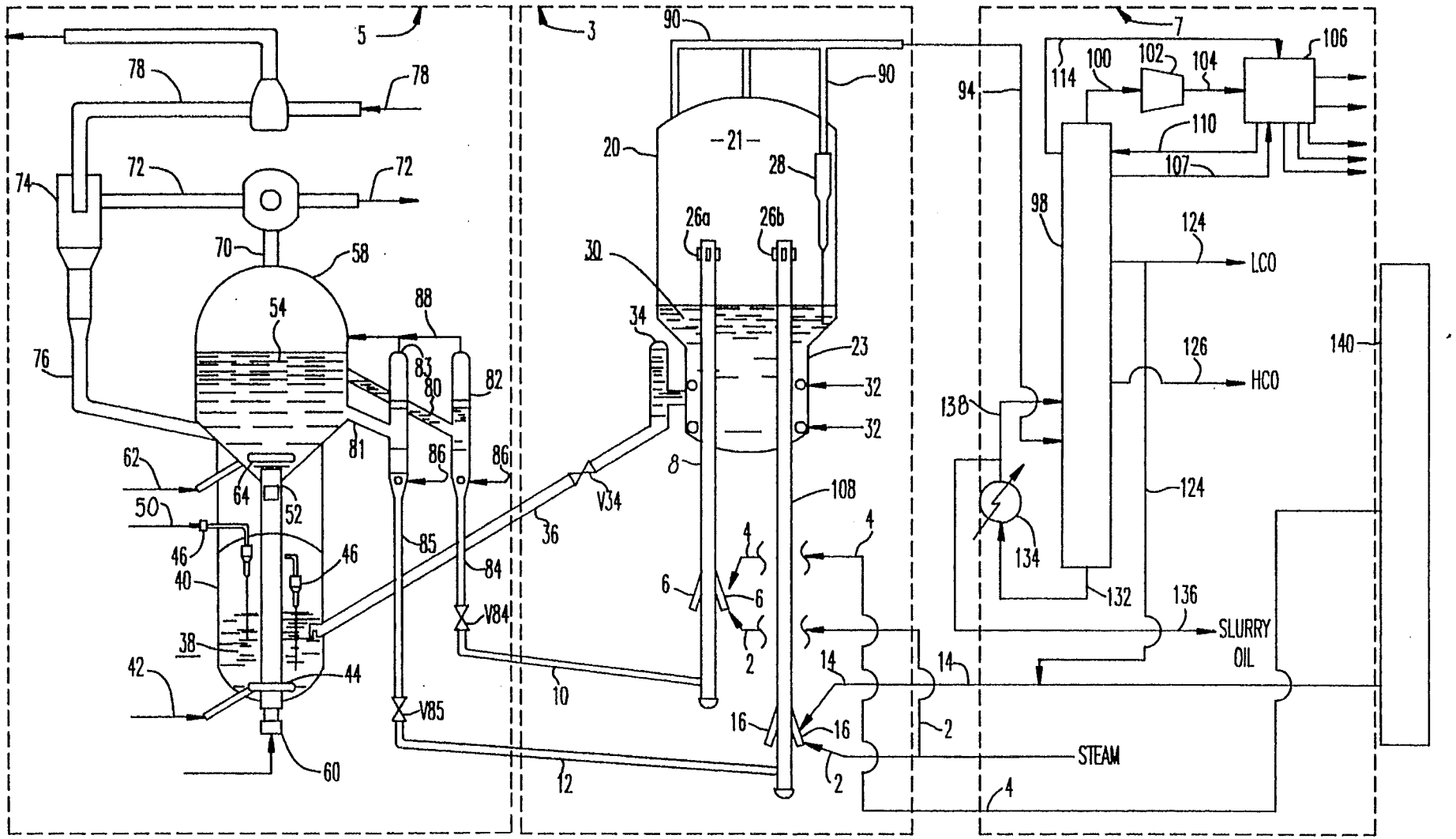
FIG. 1 is an elevational schematic of the process and apparatus of the present invention shown in a combination segregation/fluidized catalytic cracking/regeneration system for cracking hydrocarbon feeds comprising high Concarbon and paraffin rich components, wherein catalyst regeneration is successively conducted in two separate, relatively lower and higher temperature zones.

The catalytic cracking process of this invention is directed to the segregated simultaneous fluidized catalytic cracking of two separate hydrocarbon feedstocks in separate reactors. The basis for segregation of these feedstocks is the value of the VGO portion and the CCR level of each so as to achieve a first feed, characterized by a high concentration of paraffinic hydrocarbons, the VGO portion having a K value of 12.2 or higher, and a lower level of CCR, and a second feed, characterized by high levels of CCR so as to yield high initial levels of contaminant coke. segregation may be accomplished by the avoidance of commingling heavy naphthenic atmospheric residues such as Middle East, Indonesian Duri, etc. with waxy atmospheric residues such as Indonesian Minas, Malaysian Topis or Chinese Tacking. Alternatively, in the case of a commingled or single feedstock characterized by a paraffinic character of the feed boiling up to 1100° F. coupled with a high level of CCR, such segregation may be accomplished by vacuum distillation into vacuum gas oil and vacuum residue fractions which are then processed separately.

Catalysts and hydrocarbons in the effluents of individual reactors can be separated at the exit from each reactor or, preferably, the effluents of the reactors are commingled prior to separation. In the latter case, the objectives of the commingling include (1) minimizing thermal degradation providing a means for reducing the temperature of one of the reactors which may be operating at an elevated temperature and/or higher catalyst-to-oil ratio in order to achieve improved reaction selectivity by employing a short residue time (0.1–0.5 seconds); (2) providing additional reaction environment containing active catalyst from the low CCR/paraffin reactor to achieve increased conversion of the product from the high CCR reactor.

A further variant involves employing the high CCR reactor in a short residence mode principally to vaporize the feed at low conversion, separating the hydrocarbon and catalyst and then feeding the hydrocarbon to the second reactor for processing together with the low CCR feed.

Although the reactors are generally illustrated as risers herein, the reactors employed in these operations may either be conventional FCC risers in which oil and catalyst are introduced at the bottom of an elongated cylindrical reactor and the reaction proceeds with the catalyst and hydrocarbon commingled in a dilute phase as they travel vertically upward or alternately in a downflow reactor of the general type described in U.S. Pat. No. 4,814,067.

The process of this invention proceeds by cracking a predominantly heavy naphthenic/aromatic feedstock fraction, said fraction generally described as a high CCR atmospheric resid or a vacuum resid having a boiling range of about 1050° F. and greater, an API of from about 8 to about 25 and a CCR of from about 4 wt % to about 16 wt %, concurrently with the cracking of a paraffin rich feedstock, generally described as having a boiling range of less than 1050° F., an API specific gravity of from about 23 to about 35, a VGO portion K value of 12.2 or higher and a CCR of from 0 wt % to about 6 wt %, in separate reactors utilizing regenerated catalyst from an external catalyst regeneration system. The relative feed rate of the second reactor to the first reactor is generally about 0.5–1.5:1.

It is understood, however, that the fractions have boiling points varying in the ranges described above. As such, when processing a naturally occurring or blended mixture in a vacuum tower the cut point of the fractions can be varied depending on the unit and the feedstock. For instance, when the mixture is heavy, a lower cut point, i.e. at about 950° F. or more, resulting in less distillate and more resid, can be used. Also, if more gas oil remains in the resid, less or even no diluent need be added for cracking. Moreover, depending on the feedstock, the paraffin rich fraction can be a full atmospheric tower bottom.

The feedstocks comprising the high CCR feeds and paraffin rich feeds are segregated if separate, without the need for distillation. With a mixture, the feedstock comprising fraction components including naphthenic materials or atmospheric resids and paraffin rich vacuum gas oils is introduced into a vacuum tower and separated based on the boiling range of the components. As set forth above, the cut from the vacuum tower is preferably taken at about 1050° F., however, the cut can be as low as 950° F. to provide a diluent to the high CCR fraction, or even a full atmospheric tower bottom, depending on the unit and the specific feedstock. It is also understood that the separated resid component stream can contain a certain amount of the paraffin rich component.

Products obtained from cracking such feedstocks include, but are not limited to, light hydrocarbon materials, gasoline and gasoline boiling range products from $C_5$ boiling to 430° F., light cycle oil boiling in the range from 430° F. to 680° F. and a heavy cycle oil product with a boiling point higher than LCO.

As best seen in FIG. 1, a system for implementing a preferred embodiment of the process consists generally of a riser reactor assembly 3, a catalyst regenerator system 5 and a fractionation system 7. In addition, when segregation of the components requires separation of a single feed into a paraffin rich fraction and a heavy resid fraction, the system will include a vacuum tower 140.

The basic components of the reactor assembly 3 comprise an elongated riser reactor 8 for cracking the paraffin rich feed, an elongated riser reactor 108 for cracking the heavy resid feed and a vessel 20 having an upper dilute phase section 21 and a stripper section 23.

The basic components of the regenerator system 5 comprise a first stage regenerator 40, a second stage regenerator 58 and catalyst collection vessels 82 and 83.

The fractionation system 7 is, in essence, a conventional distillation column 98 provided with ancillary equipment.

The process proceeds by introducing hot regenerated catalyst into a mix zone of the first riser reactor 8 by conduit means 10. The catalyst is caused to flow upwardly and become commingled with the multiplicity of hydrocarbon feed streams in the first riser reactor 8. The catalyst is introduced at a temperature and in an amount sufficient to form a high temperature vaporized mixture or suspension with the paraffinic hydrocarbon feed. The paraffin rich hydrocarbon feed to be catalytically cracked is then introduced into the mix zone of the first riser reactor 8 by conduit means 4 through a multiplicity of streams in the riser cross section, charged through a plurality of horizontally spaced apart feed injection nozzles indicated by injection nozzle 6.

The nozzles 6 and 16 for charging the feed are preferably atomizing feed injection nozzles of the type described, for example, in U.S. Pat. No. 4,434,049 which is incorporated herein by reference, or some other suitable high energy injection source. Steam, fuel gas, reaction recycle, carbon dioxide, water or some other suitable gas can be introduced into the feed injection nozzles through conduit means 2 as an aerating, fluidizing or diluent medium to facilitate atomization or vaporization of the hydrocarbon feed.

Cracking conditions in riser 8 designed to produce cracked products from the paraffin rich feed, comprising light olefins, cracked gasoline and LCO or diesel, do not have the expected limitation of insufficient coke make to fuel the reaction due to the parallel processing of the high Concarbon component in the second riser 108 and, therefore, is unconstrained by heat balance.

The paraffin rich feed, comprising lower boiling point components, tends to contain a negligible amount of carbon upon cracking wherein the paraffins crack with higher selectivity to desired products but lower selectively to $C_2$ and lighter gases and coke. Thus, the lower boiling paraffin feed component is cracked at the optimum conditions required to maximize high octane gasoline and/or light cycle oil yields with high selectivity and reduced catalyst fouling.

Alternatively, the light feed is cracked at high temperature for olefin production, with conditions tailored for that feed and not subject to compromises imposed by heavy constituents. As another alternative, the light feed is cracked under conditions necessary to achieve the selectivity anticipated by short residence time cracking (i.e., 0.1–0.5 seconds). Such conditions generally include higher than normal temperatures (i.e., over 1050° F.) and high catalyst activity from higher catalyst-to-oil ratios or specifically designed catalysts.

Figure 3:
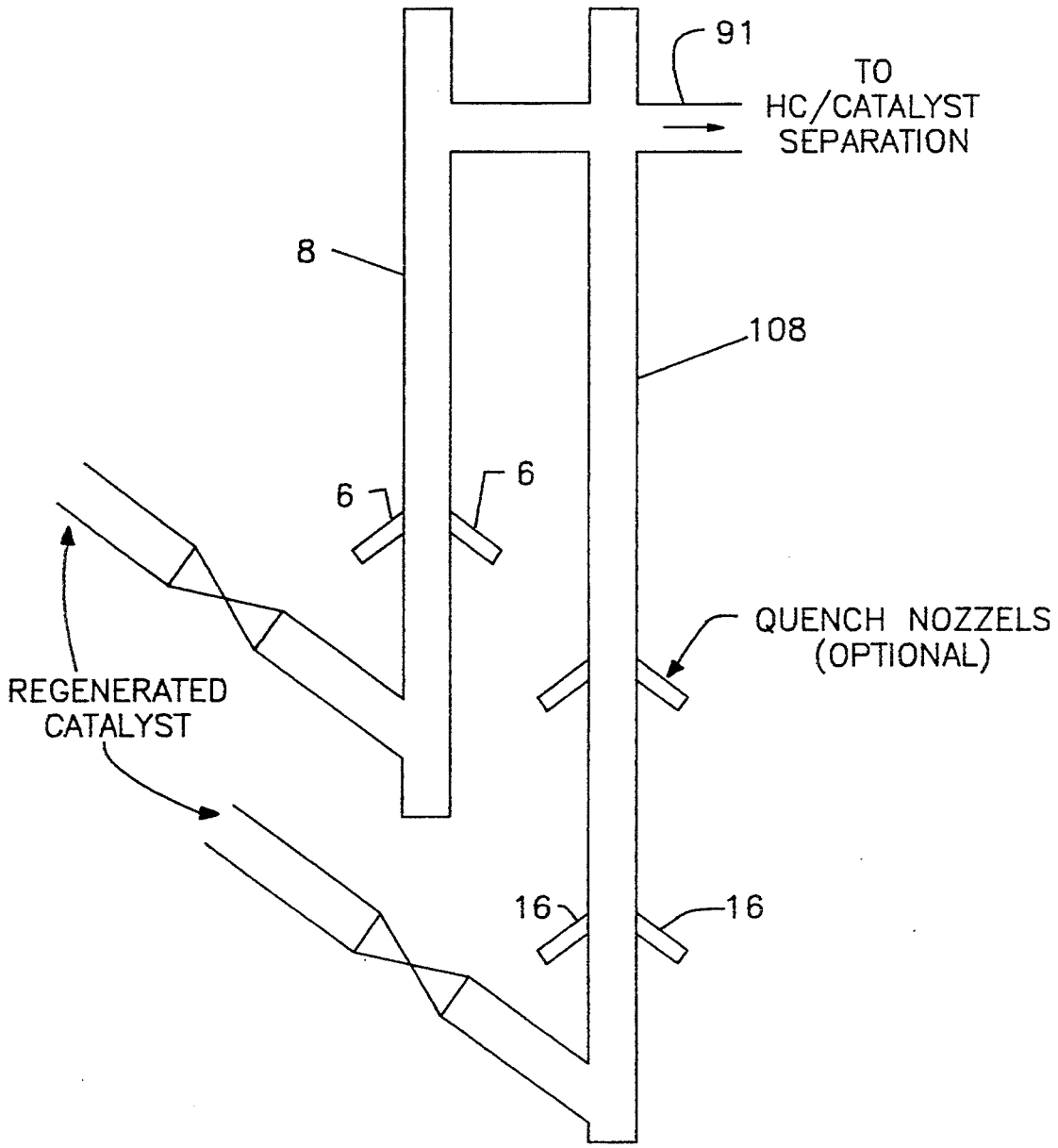
FIG. 3 is a partial elevational schematic view of the risers comprising a variation of the present invention wherein the risers discharge into a common line before the cracked effluent is separated from the catalyst.
Figure 4:
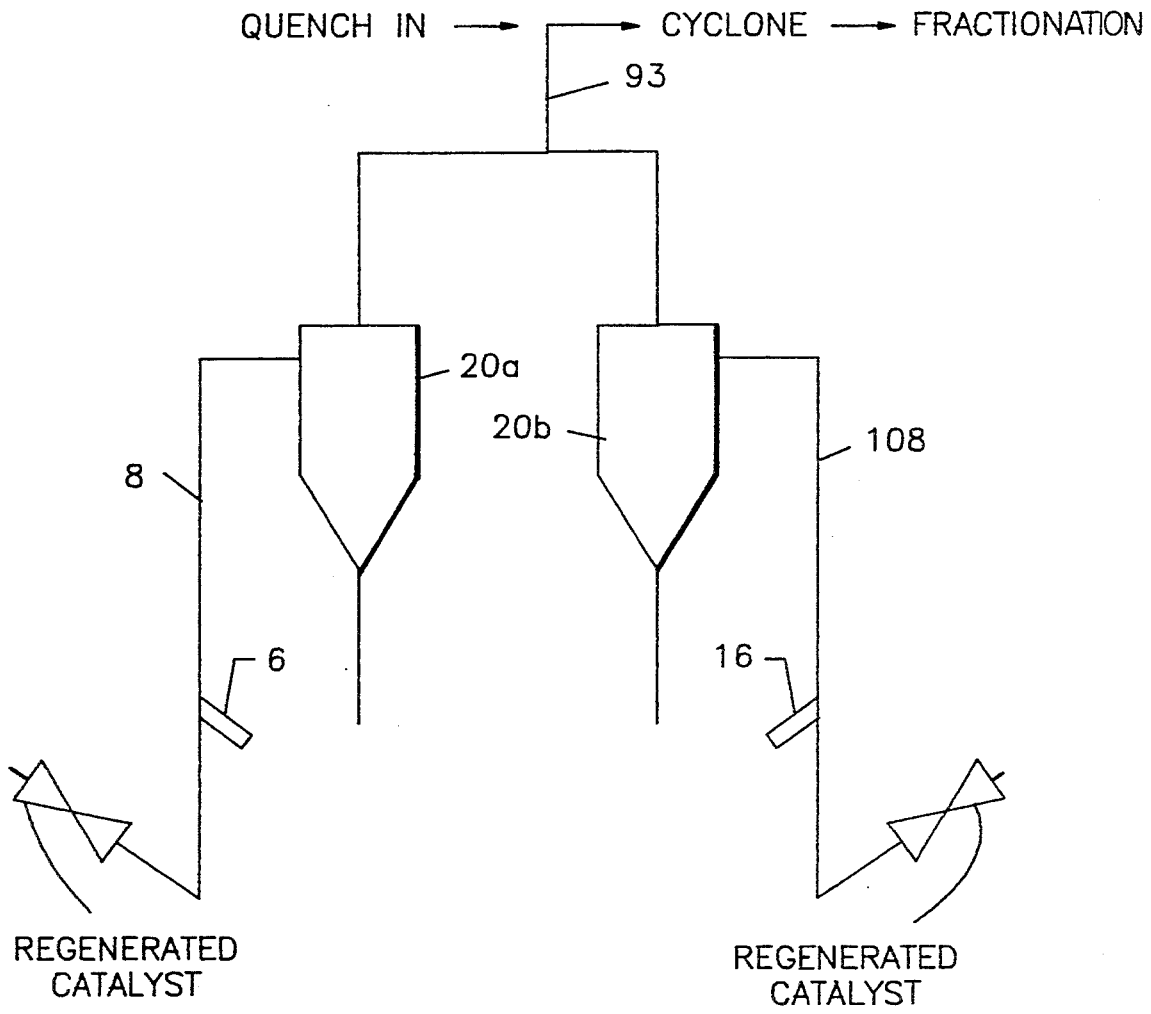
FIG. 4 is a partial elevational view of the risers and separation system comprising individual separators for each riser where the vapor outlets are combined after separation and quenched.

Notwithstanding, preferred cracking conditions for the paraffin rich fraction include residence times in the range of 0.1–3 seconds, preferably 0.5 to 2 seconds with a riser temperature provided by regenerated catalyst at temperatures from 1300° F. to 1600° F., feed preheat temperatures from 300° F. to 700° F., and riser outlet temperatures (ROT) from 920° F. to 1100° F., with riser pressures ranging from 15 to 40 psig. Alternatively, good results have been achieved with residence times of less than 1 second and an ROT of over 1050° F., especially useful in the system of FIG. 3.

The process can also include intermediate injection nozzles (not shown) to inject a temperature control medium into the reactor after the mix zone or between reaction zones in the reactor, to more carefully adjust the reaction zone temperatures in one or both of the reactors. This concept is more fully described in U.S. Pat. No. 5,087,349 and preferably utilizes LCO recycle from conduit 124 shown herein.

Catalyst-to-oil ratios based on total feed can range from 3 to 12, with coke on regenerated catalyst ranging from 0.3 to 1.2 weight percent and overall coke make from about 3.0 to 6.0 wt %. The catalyst/oil ratio is preferably set to maintain a delta coke level of 1.0 or less. The amount of diluent, if any, added through conduit means 2 can vary depending upon the ratio of paraffin rich feed to diluent desired for control purposes. If, for example, steam is employed as a diluent, it can be present in an amount of from about 2 to about 8 percent by weight based on the paraffin rich feed charge.

The first reactor effluent, comprising a mixture of cracked products of catalytic conversion and suspended catalyst particles, passes from the upper end of riser 8 through an initial separation in a suspension separator means, preferably including a quench, indicated by 26*a* such as an inertial separator, and/or is passed to one or more cyclone separators 28 located in the upper portion of vessel 20 for additional separation of volatile hydrocarbons from catalyst particles. The separator of Ser. No. 07/756,479, now abandoned refiled as Ser. No. 08/041,680, now U.S. Pat. No. 5,259,855 incorporated herein by reference, is particularly well-suited for the system of this invention. Separated vaporous hydrocarbons, diluent, stripping gasiform material and the like are withdrawn by conduit 90 for passage to product recovery equipment more fully discussed hereinbelow.

Simultaneously with the paraffin rich feed fraction cracking operation taking place in the first riser 8, as described above, hot freshly regenerated catalyst from the second regeneration zone 58 is introduced into the second riser reactor 108 mix zone by conduit means 12 and caused to flow upwardly. CCR fraction to be catalytically cracked introduced into the mix zone of the second riser reactor 108 by conduit means 14. The introduced through a multiplicity of streams in cross section, charged through a plurality of horizontally spaced apart feed injection nozzles indicated by 16. The nozzles 16 are preferably atomizing feed injection nozzles or similar high energy injection nozzles of the type described above.

The catalyst is charged to the mix zone of the second riser 108 at a temperature and in an amount sufficient to form a high temperature vaporized mixture or suspension with the high CCR hydrocarbon feed thereafter charged to the mix zone. As in the first riser reactor 8, steam, fuel gas, reaction recycle or some other suitable gas can be introduced into the feed injection nozzles 16 through conduit means 2 to facilitate atomization and/or vaporization of the hydrocarbon feed, or as an aerating, fluidizing or diluent medium. The temperature in the mix zone of the second riser 108 is in the range of from about 950° F to about 1150° F.

The high temperature suspension thus formed and comprising naphthene hydrocarbons, diluent, fluidizing gas and the like, and suspended (fluidized) catalyst, thereafter passes through riser 108, which is operated independently from the first riser 8, in a manner to selectively catalytically crack the high CCR feed to desired products, including high octane gasoline and gasoline precursors, and light olefins.

Hot, freshly regenerated catalyst from the second stage 58 of the regenerator, as shown in FIG. 1, is introduced into the mix zone of the second riser 108 at a temperature generally above 1300° F. The heavy resid feed is preheated to a temperature of from about 300° F. to about 700° F. and is injected into the mix zone of the second elongated riser reactor 108. The mix zone of the second riser 108 is maintained at a temperature of from about 950° F. to about 1150° F. The residence time in riser 108 is 0.5–4 seconds, preferably 1–2 seconds. The riser outlet temperature is between 950°–1100° F.

Preferred cracking conditions in the second riser reactor 108, to selectively produce desired cracked products from the high CCR feed, take into account the fact that heavy carbon laydown on the catalyst, e.g. hydrocarbonaceous material or coke build up (which can be liberally provided by heavy feed residual oils and the like), is a greater detriment to gasoline selectivity when cracking a paraffinic feed than when cracking a naphthenic feed, although it can be a detriment to both. Therefore, a net advantage in terms of gasoline selectivity is achieved by permitting the low CCR paraffin rich feed to undergo cracking in the first riser reactor 8 independently of the second riser reactor 108 and in the absence of the heavy feed and substantial coke laydown which inhibits conversion of the slower reacting paraffin rich feed.

Moreover, by employing separate riser reactors 8 and 108 to optimize feed conversion to improve desired yields in an operation with a unitary catalyst regeneration system, the heat balance can be maintained notwithstanding the reduced coke make from the paraffin rich feed component. It will, therefore, be appreciated that such carbon on catalyst effects and diluent effects described herein are independent and can be manipulated in an advantageous manner in the process of the present invention to cooperate and enhance gasoline selectivity in the overall system.

Increased catalytic conversion of paraffins provides high yields of gasoline products unavailable when processed with a resid fraction. Further, conversion of the resid component can take place with more fouled catalyst and still result in favorable gasoline production.

Figure 2:
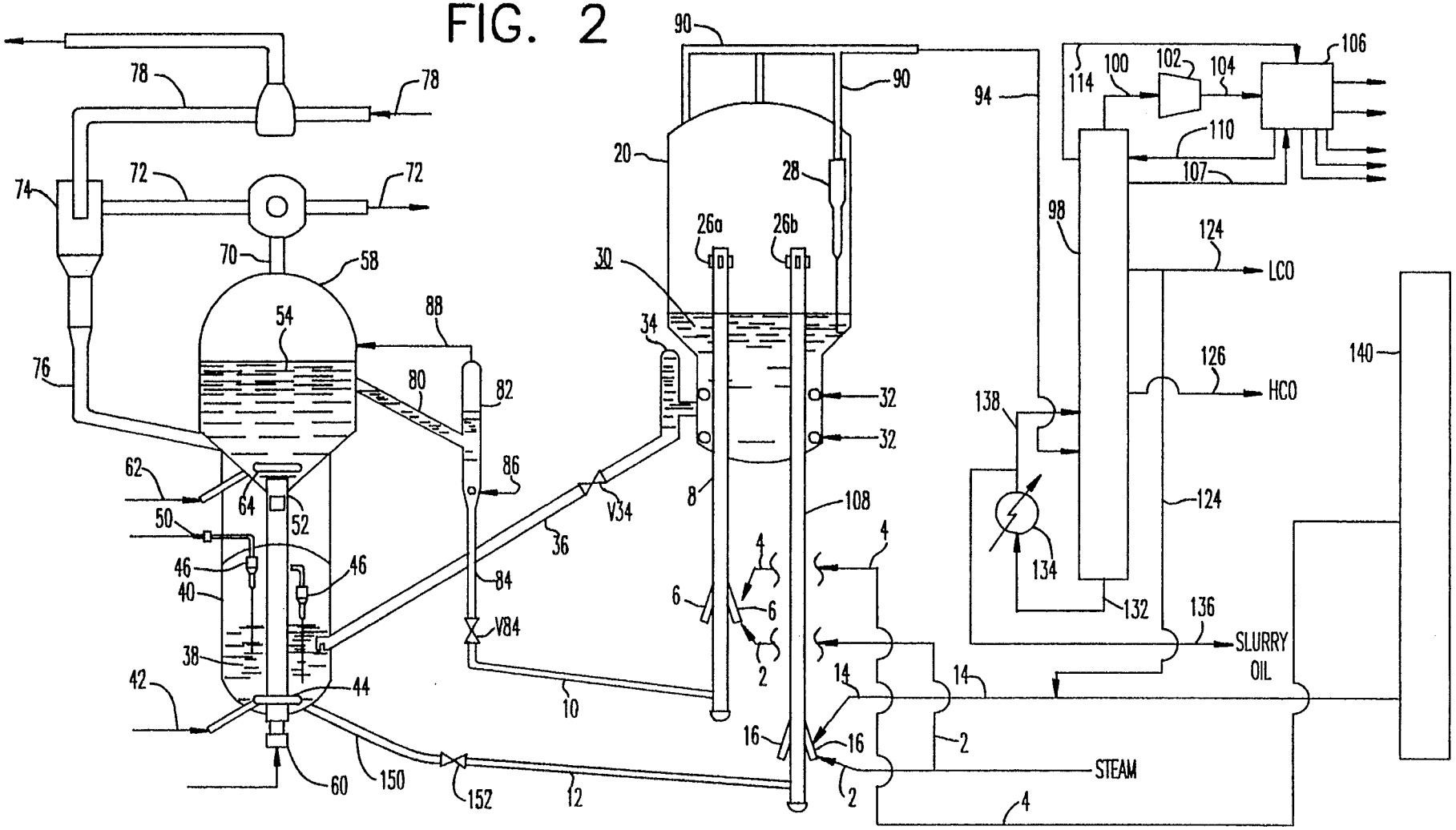
FIG. 2 is a schematic view of an alternative process and apparatus where catalyst for the resid riser is taken from the first stage of the catalyst regeneration system.

FIG. 2 shows a variation of the present invention where the catalyst for the second riser 108, in which the resids are cracked, is taken from the first regeneration vessel 40 in a partially regenerated state, i.e. with from about 40 to 80% and more preferably about 60% of the coke removed, rather than from the second regeneration vessel 58 where the catalyst is fully regenerated. As in the embodiment of FIG. 1, the catalyst for the first riser 8, in which the paraffin rich VGO is cracked, is taken from the second regeneration vessel 58 after it is fully regenerated.

Use of the partially regenerated catalyst for the second riser 108 is possible because the resids introduced into the second riser 108 can be cracked by partially fouled catalyst. The partially regenerated catalyst, with from about 20% to about 80% and preferably about 60% of the coke formed during the reaction removed in the first regeneration vessel 40, is taken from the bottom of the catalyst bed 38 of the first regeneration vessel 40, below the gas distribution ring 44 at a point proximate the inlet to the riser 52 which delivers the partially regenerated catalyst from the first regeneration vessel 40 to the second regeneration vessel 58.

As shown in FIG. 2, the partially regenerated catalyst from the bottom of the catalyst bed 38 of the first regeneration vessel 40 is removed through line 150, restricted by flow control valve 152, and passed through line 12 into the catalyst injection zone of the second riser 108.

Thus, it will be appreciated by those skilled in the art that the process of the present invention, in addition to providing selective control of optimal cracking conditions of specific feed components, also provides a means for achieving higher overall yield from a feedstock which is not comprised of necessarily compatible components. This result is made possible by the use of a catalyst regeneration system for regeneration of catalyst from both risers to maintain an overall heat balance favoring the reaction, not available from independent processing of the paraffin rich feed which cannot fuel its own reaction, or processing of the combined, unsegregated feed which would require catalyst cooling.

In accordance with the above, the high CCR feed is preferably catalytically cracked in the second riser 108 under conditions involving residence times of from about 1 to about 4 seconds, with feed preheat temperatures from about 450° F. to about 700° F., riser reactor mix zone outlet temperatures from about 950° F. to about 1150° F., catalyst inlet temperatures from about 1000° F. to about 1300° F. and riser reactor outlet temperatures from 950° F. to 1100° F., with riser pressures ranging from 15 to 40 psig. Catalyst-to-oil ratios in the second riser reactor based on total feed can range from 8 to 12 with coke make on regenerated catalyst ranging from about 0.8 to about 1.5 wt % and total coke make from about 12 to about 20 wt %.

Figure 5:
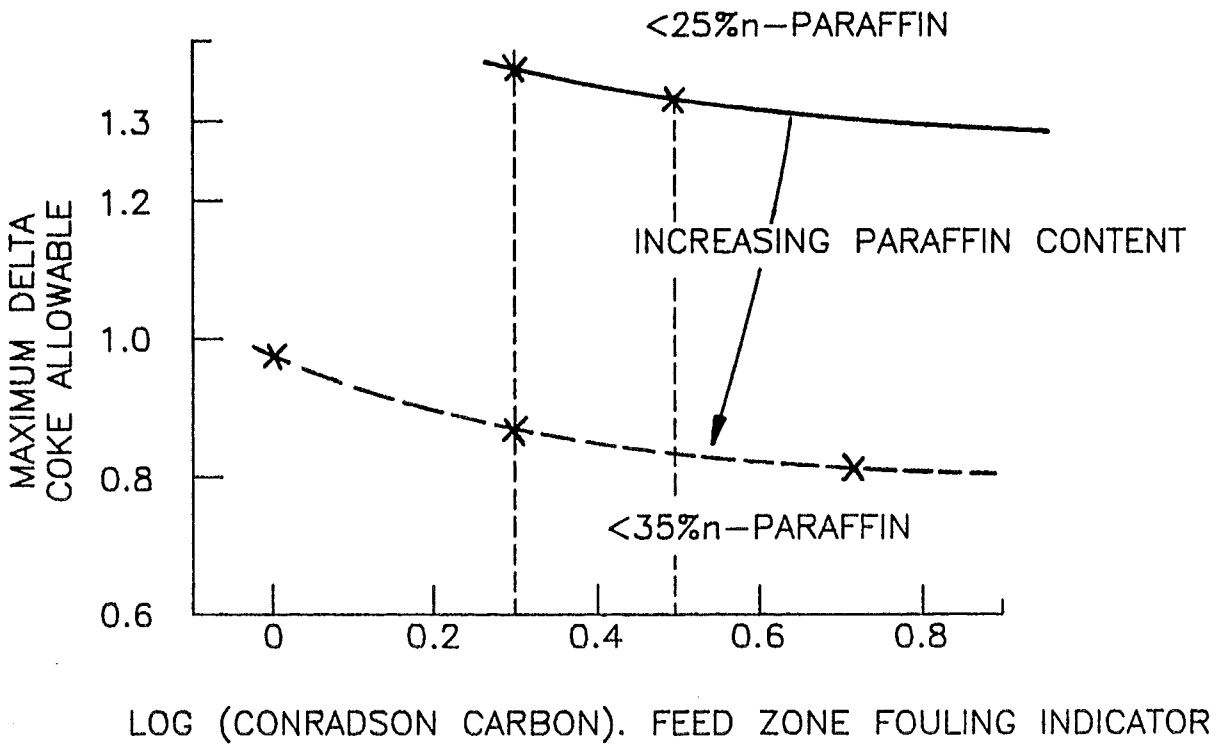
FIG. 5 is a graph illustrating the feedstock effect on the maximum delta coke allowable based on paraffin content using low rare earth, low matrix activity catalyst.
Figure 6:
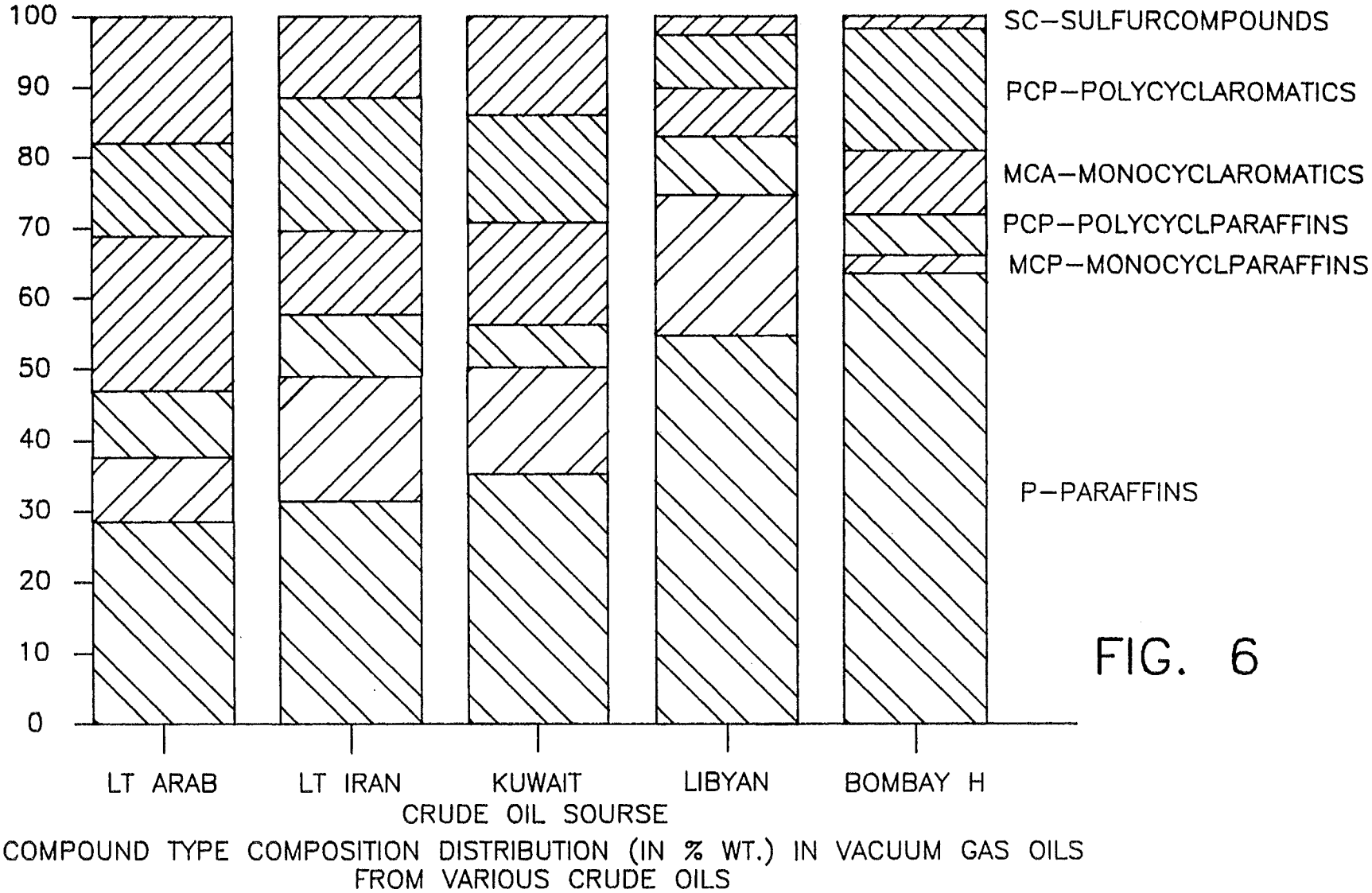
FIG. 6 is a chart of the compound type composition distributions in vacuum gas oils from various crude oils in weight percent.
Figure 7:
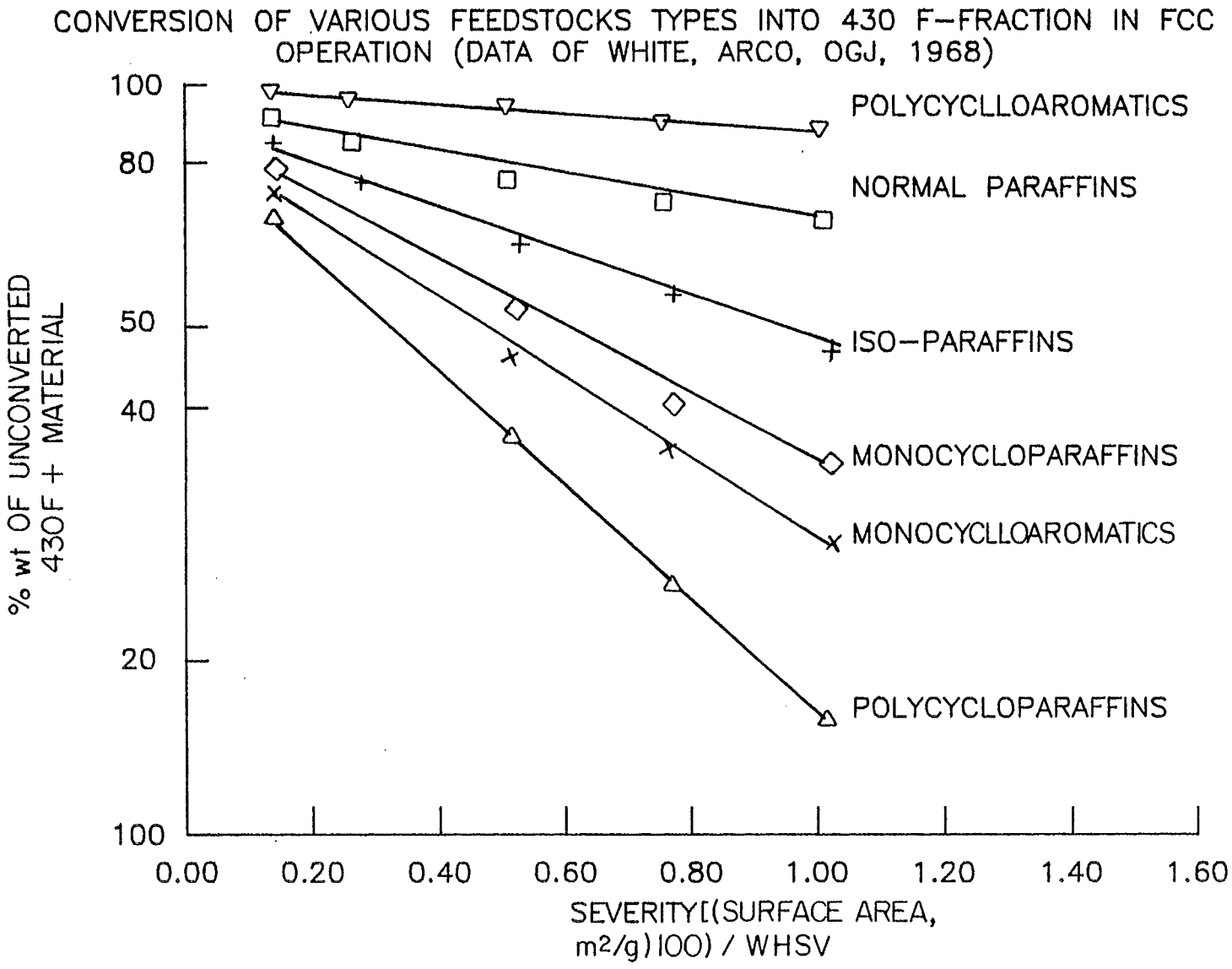
FIG. 7 is a graph illustrating the effect of various compound types on conversion into 430° F. material.
Figure 8:
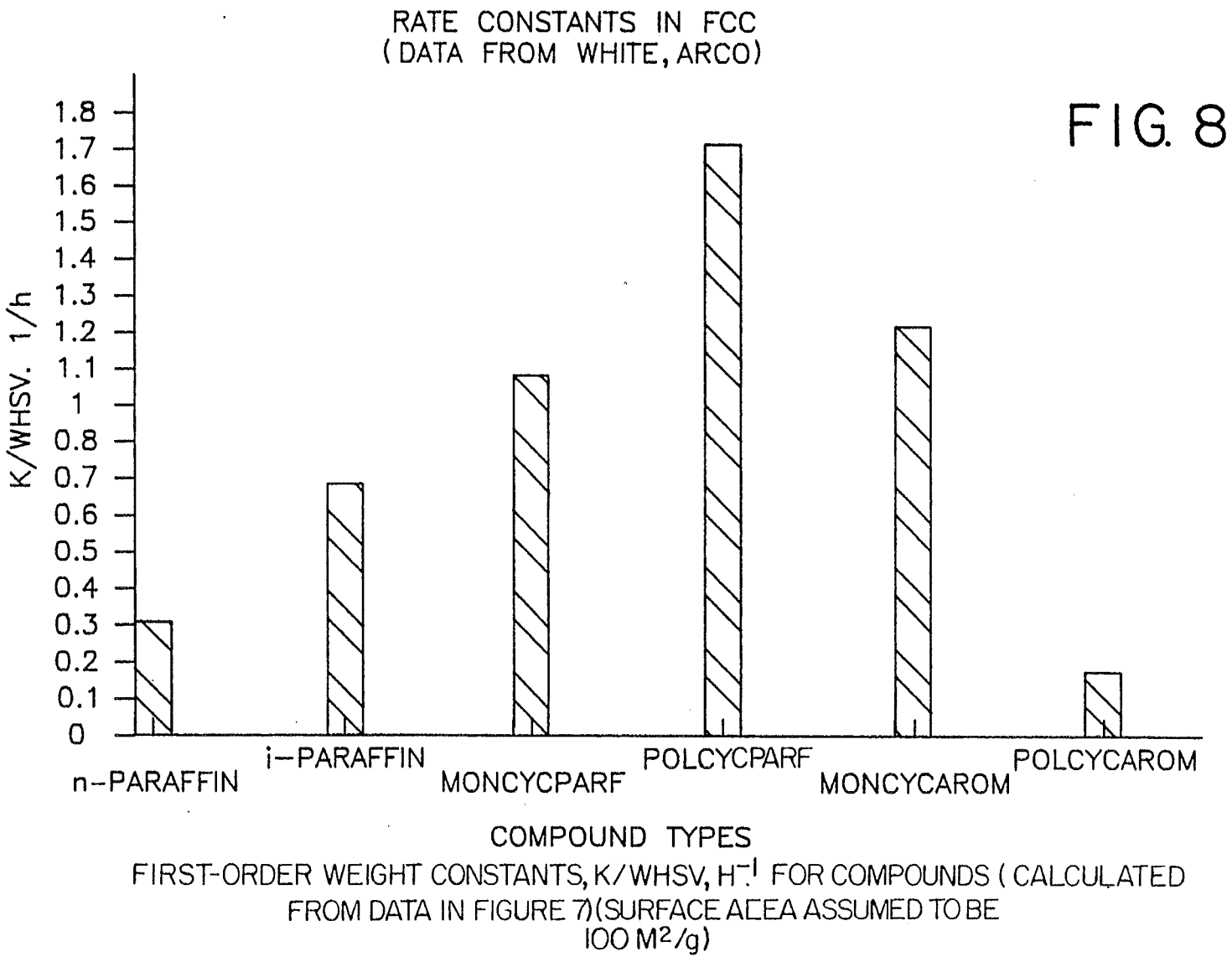
FIG. 8 is a chart showing the rate constants in FCC for various compound types.
Figure 9:
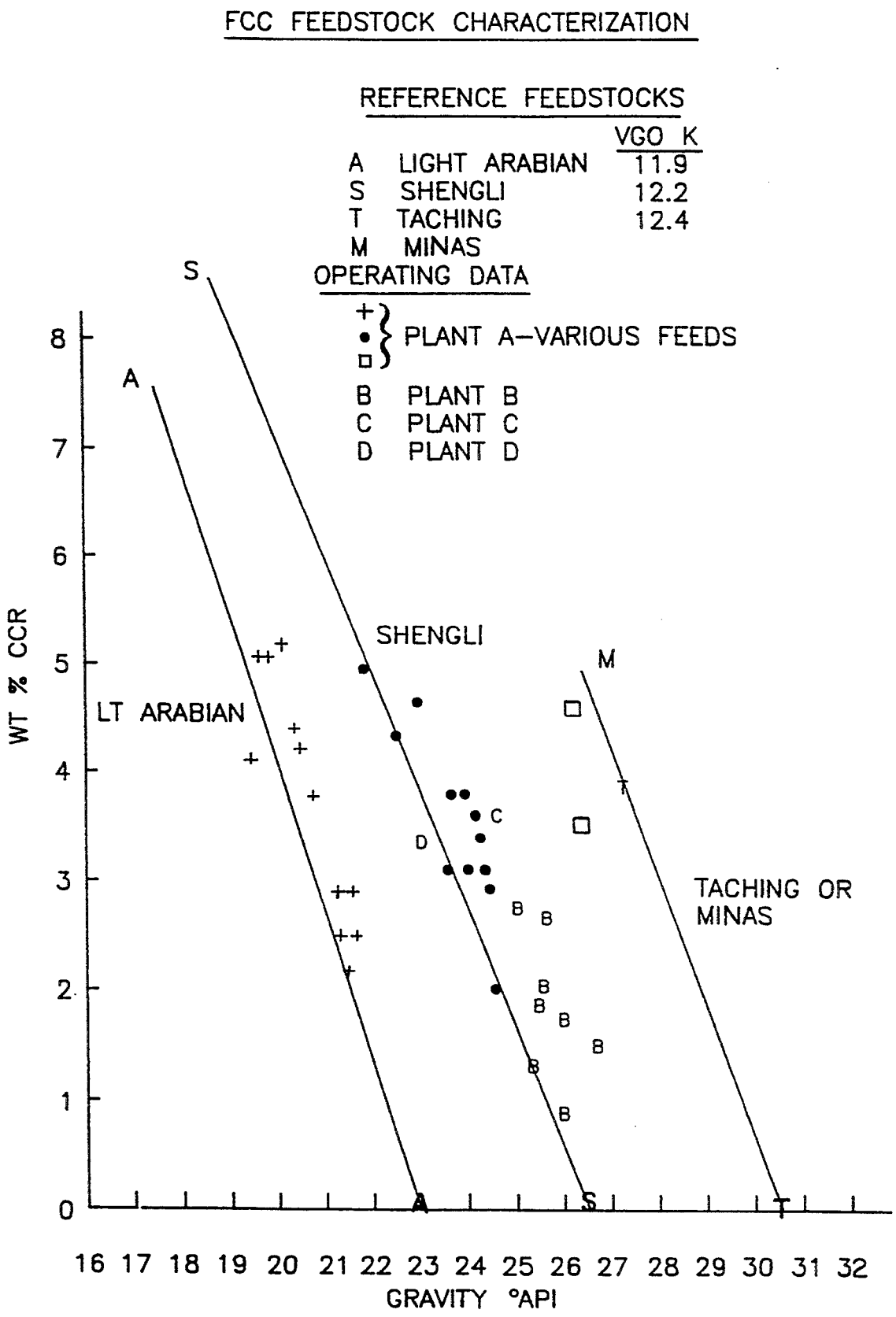
FIG. 9 is a graph of feedstock characterization based on an API gravity/Conradson Carbon relationship.
Figure 10:
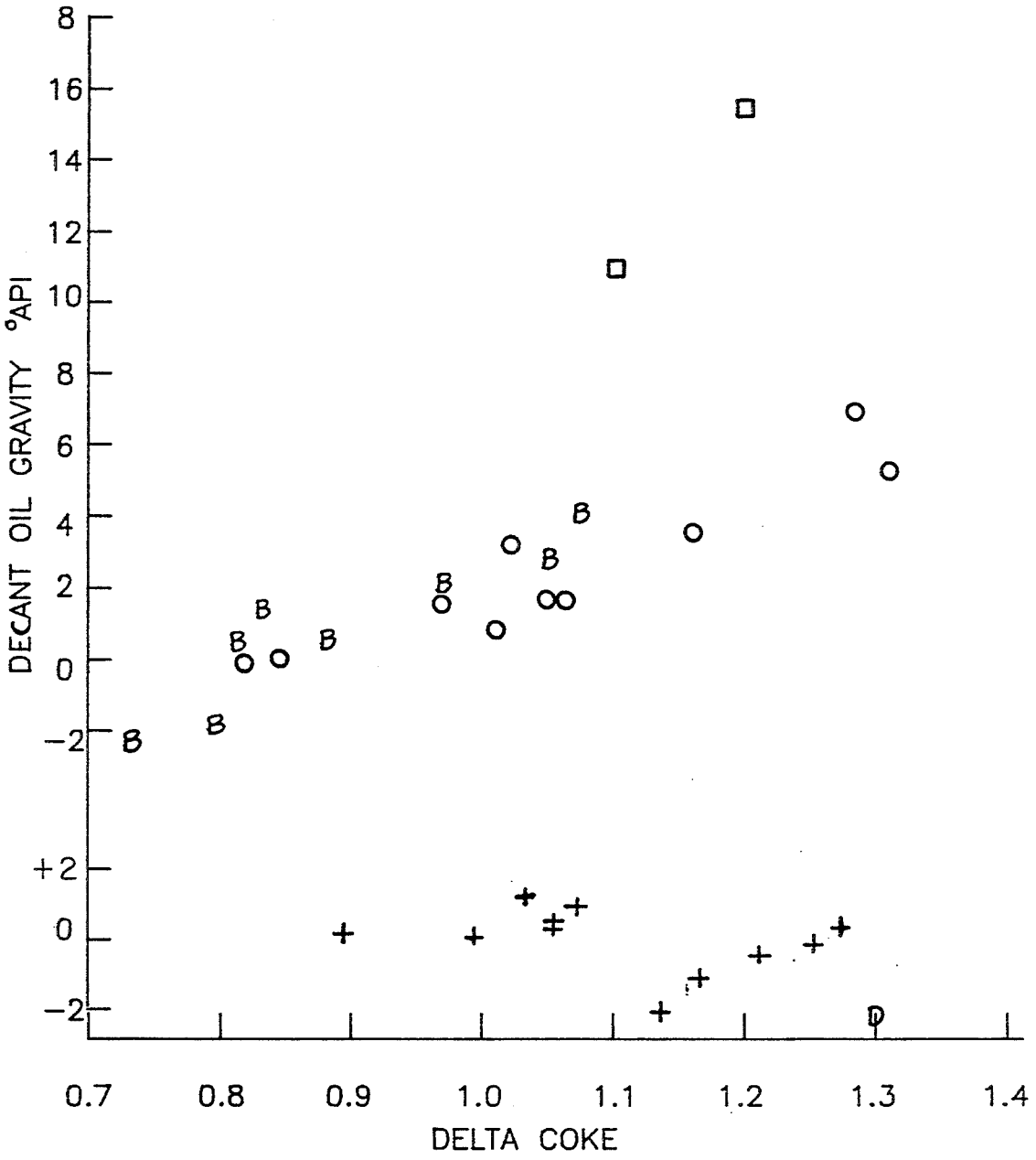
FIG. 10 is a plot of decant oil API gravity as a function of delta coke for the data of FIG. 9.
Figure 11:
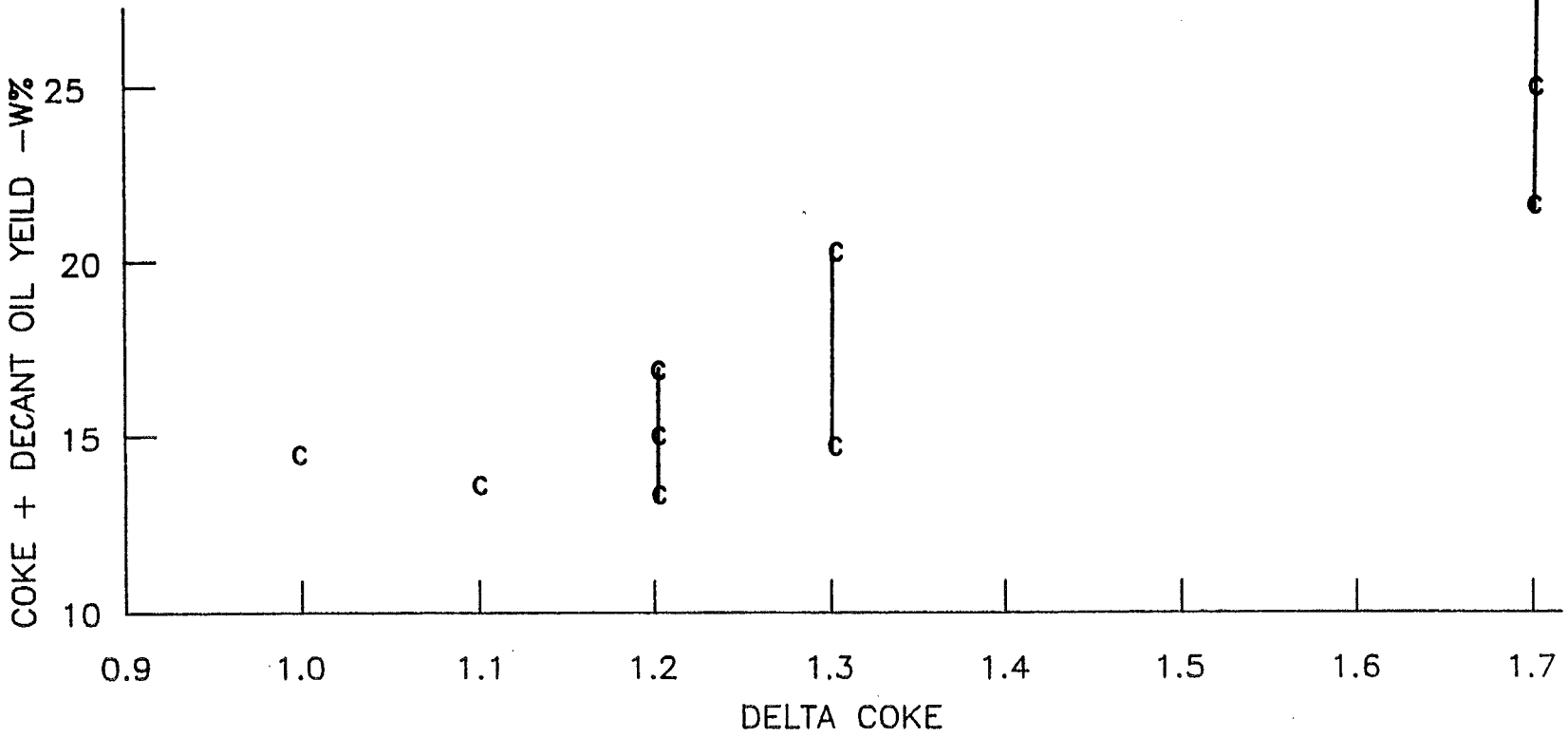
FIG. 11 is a plot of coke and decant oil yield in weight percent as a function of delta coke.

Referring again to FIG. 5, to determine the feedstock effect on delta coke allowable, the sharp tail on the curves at low carbon residue values is attributed to minimal feed zone fouling of the catalyst. As the delta coke increases for a clean feed which produces a low coke yield, the catalyst-to-oil ratio drops quickly and at some point the riser will no longer be catalytic. Feeds containing a high content of paraffins are therefore limited to lower delta coke levels due to the need for high catalyst activity, measured in this case as catalyst-to-oil ratio in the relative absence of feed contaminants. As the carbon residue increases, immediate fouling of the catalyst in the feed zone increases and the maximum delta coke reduces rapidly for highly paraffinic feeds. The curve is more flat for the lower paraffinic feeds.

The curves flatten as the carbon residue increases due to the higher catalyst-to-oil ratio required, tending to dilute the feed zone contamination caused by higher carbon residue (higher carbon residue indicates higher coke yield, therefore, to reduce the delta coke the cat-/oil ratio increases significantly). The use of a catalyst cooler permits operation at a higher coke yield, but the amount of catalyst which must be circulated increases drastically, reducing efficiency. As such, it is preferred to set the catalyst/oil ratio to maintain a delta coke level of about 1.0 or lower.

Effluent from the second riser reactor 108 comprising a vaporized hydrocarbon-catalyst suspension including catalytically cracked products of naphthenic resid conversion passes from the upper end of the second riser 108 through an initial separation, and preferably quench, in a suspension separator means **26*b* such as described above and/or is passed to one or more cyclone separators 28 located in the upper portion of vessel 20 for additional separation of volatile hydrocarbons from catalyst particles, also as described above. Separated vaporous hydrocarbons, diluent, stripping gasiform material and the like can be withdrawn by conduit 90 for additional quenching prior to or after combination with such material from the cracking operation in riser reactor 8**, and for passage to product recovery equipment discussed below.

Figure 12:
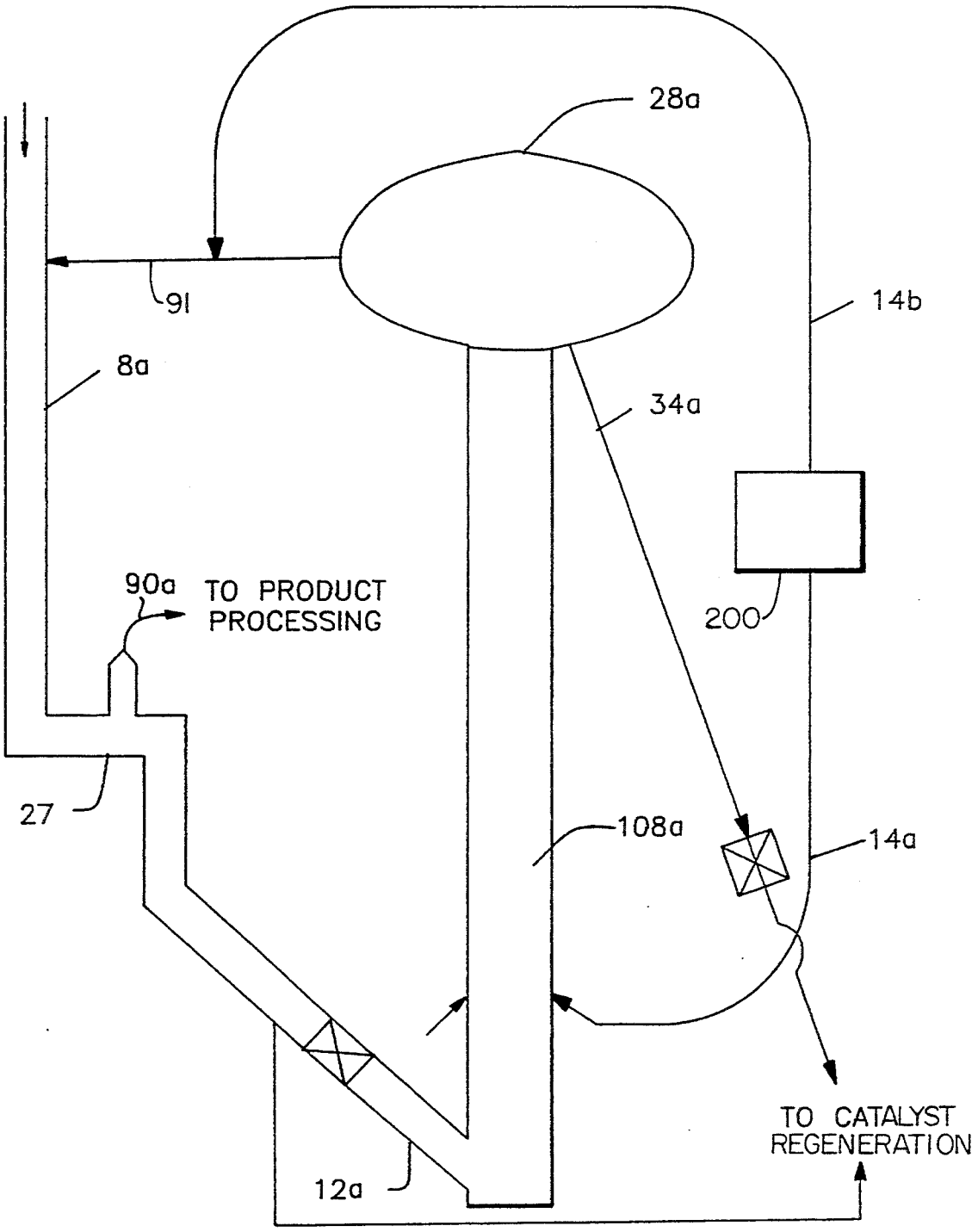
FIG. 12 is a partial elevational view of an alternative embodiment of the reactor assembly portion of the present invention.

In an alternative embodiment for the cooperative coprocessing of high and low CCR feeds, as shown in FIG. 12, the unvaporized high CCR feed from tar separator 200 is introduced into reactor **108*a* along line 14*a* with catalyst from conduit 12*a* in a mix zone. The heavy feed is processed at a residence time in the range of 0.2 to 0.5 seconds and a temperature of from about 950° F. to about 1050° F., to vaporize the hydrocarbon in a high catalyst/oil environment. The vaporized hydrocarbons are then separated from the catalyst in separator 28*a*, with the catalyst then sent through conduit 34*a* to the catalyst regeneration system 5, and the vaporized hydrocarbons passed to the mix zone of the low CCR reactor 8a along conduit 91 for processing with the low CCR feed and fresh catalyst. The low CCR reactor runs at temperatures, residence times and cat/oil ratios as set forth above. Product gases from the low CCR reactor 8*a* are separated from catalyst in separator zone 27 and sent onto downstream processing in zone 7 along conduit 90*a*. The vaporized high CCR feed from tar separator 200 is passed along line 14*b* and mixed with the vaporized high CCR feed exiting the high CCR reactor 108*a*. Further, the catalyst from the low CCR reactor 8*a* may be used as the catalyst in the high CCR reactor 108*a*** without regeneration.

In the preferred embodiment, once the product gases are achieved the spent catalyst from the cracking processes of riser reactors 8 and 108 are separated by separator means **26*a* and 26*b* and cyclones 28. The spent catalyst, having a hydrocarbonaceous product or coke from cracking and metal contaminants deposited thereon, is collected as a bed of catalyst 30 in a lower portion of vessel 20. Stripping gas such as steam is introduced to the lower or bottom portion of the bed by conduit means 32. Stripped catalyst is passed from vessel 20 into catalyst holding vessel 34, through flow control valve $V_{34}$ and conduit means 36 to a bed of catalyst 38 being regenerated in the first regeneration vessel 40. Oxygen-containing regeneration gas such as air is introduced to a bottom portion of bed 38 by conduit means 42 communicating with air distributor ring 44. Regeneration zone 40, as operated in accordance with procedures known in the art, is maintained under conditions as a relatively low temperature regeneration operation generally below 1300° F., and preferably below 1260° F. Conditions in the first regeneration zone 40** are selected to achieve at least a partial combustion and removal of carbon deposits and substantially all of the hydrogen associated with the deposited hydrocarbonaceous material from catalytic cracking.

The combustion accomplished in the first regeneration zone 40 is thus accomplished under such conditions to form a carbon monoxide rich first regeneration zone flue gas stream. Said flue gas stream is separated from entrained catalyst fines by one or more cyclone separating means, such as indicated by 46. Catalyst thus separated from the carbon monoxide rich flue gases by the cyclones is returned to the catalyst bed 38 by appropriate diplegs. Carbon monoxide rich flue gases recovered from the cyclone separating means 46 in the first regeneration zone 40 by conduit means 50 can be directed, for example, to a carbon monoxide boiler or incinerator and/or a flue gas cooler (both not shown) to generate steam by a more complete combustion of available carbon monoxide therein, prior to combination with other process flue gas streams and passage thereof through a power recovery prime mover section.

In the first regeneration zone it is therefore intended that the regeneration conditions are selected such that the catalyst is only partly regenerated by the removal of hydrocarbonaceous deposits therefrom, i.e. removal of from 40–80% and more preferably approximately 60% of the coke deposited thereon. Sufficient residual carbon is intended to remain on the catalyst to achieve higher catalyst particle temperatures in a second catalyst regeneration zone 58, i.e. above 1300° F., as required to achieve virtually complete removal of the carbon from catalyst particles by combustion thereof with excess oxygen-containing regeneration gas.

As shown in FIG. 1, partially regenerated catalyst from the first regeneration zone 40, now substantially free of hydrogen and having limited residual carbon deposits thereon, is withdrawn from a lower portion of bed 38 for transfer upwardly through riser 52 to discharge into the lower portion of a dense fluid bed of catalyst 54 in an upper, separate second catalyst regeneration zone 58. Lift gas such as compressed air is charged to the bottom inlet of riser 52 by a hollow-stem plug valve 60 comprising flow control means (not shown).

Conditions in the second catalyst regeneration zone 58 are designed to accomplish substantially complete removal of the carbon from the catalyst not removed in the first regeneration zone 40, as discussed above. Accordingly, regeneration gas such as air or oxygen enriched gas is charged to bed 54 by conduit means 62 communicating with a gas distributor such as an air distribution ring 64.

As shown in FIG. 1, vessel 58 housing the second regeneration zone is substantially free of exposed metal internals and separating cyclones such that the high temperature regeneration desired may be effected without posing temperature problems associated with materials of construction. The second catalyst regeneration zone 58 is usually a refractory lined vessel or is manufactured from some other suitable thermally stable material known in the art wherein high temperature regeneration of catalyst is accomplished in the absence of hydrogen or formed steam, and in the presence of sufficient oxygen to effect substantially complete combustion of carbon monoxide in the dense catalyst bed 56 to form a carbon dioxide rich flue gas. Thus, temperature conditions and oxygen concentration may be unrestrained and allowed to exceed 1600° F., or as required for substantially completed carbon combustion. However, temperatures are typically maintained between 1300° F. and 1400° F. with present day catalysts.

In this catalyst regeneration environment residual carbon deposits remaining on the catalyst following the first, temperature restrained regeneration zone 40 are substantially completely removed in the second unrestrained temperature regeneration zone 58. The temperature in vessel 58 in the second regeneration zone is thus not particularly restricted to an upper level except as possibly limited by the amount of carbon to be removed therewithin and heat balance restrictions of the catalytic cracking-regeneration operation. The heat balance of the catalytic operation is especially important in the present invention wherein the reaction in the first riser does not necessarily generate enough coke to fuel the reaction.

As described above, sufficient oxygen is charged to vessel 58 in amounts supporting combustion of the residual carbon on catalyst and to produce a relatively carbon dioxide-rich flue gas. The $CO_2$-rich flue gas thus generated passes with some entrained catalyst particles from the dense fluid catalyst bed 54 into a more dispersed catalyst phase thereabove from which the flue gas is withdrawn by one or more conduits represented by 70 and 72 communicating with one or more cyclone separators indicated by 74. Catalyst particles thus separated from the hot flue gases in the cyclones are passed by dipleg means 76 to the bed of catalyst 54 in the second regeneration zone 58. Carbon dioxide-rich flue gases absent catalyst fines and combustion supporting amounts of CO are recovered by one or more conduits 78 from cyclones 74 for use, for example, as described hereinabove in combination with the first regeneration zone flue gases.

As shown in FIG. 1, catalyst particles regenerated in second regeneration zone 58 at a high temperature are withdrawn by refractory lined conduits 80 and 81 for passage to collection vessels 82 and 83, respectively, and then by conduits 84 and 85 through flow control valves $V_{84}$ and $V_{85}$ to conduits 10 and 12 communicating with respective riser reactors 8 and 108. Aerating gas can be introduced into a lower portion of vessels 82 and 83 by conduit means 86 communicating with a gas distributor such as air distribution rings within said vessels. Gaseous material withdrawn from the top portion of vessels 82 and 83 by conduit means 88 passes into the upper dispersed catalyst phase of vessel 58.

The separated gaseous mixture comprising separated vaporous hydrocarbons and products of hydrocarbon cracking from the cracking operations in riser reactors 8 and 108 is withdrawn by conduit means 90 and transfer conduit means 94 directed to the lower portion of a main fractional distillation column 98 wherein product vapor can be fractionated into a plurality of desired component fractions.

From the top portion of column 98, a gas fraction can be withdrawn via conduit means 100 for passage to a "wet gas" compressor 102 and subsequently through conduit 104 to a gas separation plant 106. A light liquid fraction comprising FCC naphtha and lighter $C_3$–$C_6$ olefinic material is also withdrawn from a top portion of column 98 via conduit means 107 for passage to gas separation plant 106. Liquid condensate boiling in the range of $C_{5-430°}$ F. is withdrawn from gas separation plant 106 by conduit means 110 for passage of a portion thereof back to the main fractional distillation column 98 as reflux to maintain a desired end boiling point of the naphtha product fraction in the range of about 400°–430° F.

Also from the top portion of the distillation column 98 a heavy FCC naphtha stream can be passed through conduit means 114 as a lean oil material to gas generation plant 106.

A light cycle gas oil (LCO)/distillate fraction containing naphtha boiling range hydrocarbons is withdrawn from column 98 through conduit means 124, said LCO/distillate fraction having initial boiling point in the range of about 300° F. to about 430° F., and an end point of about 600° F. to 670° F.

It is also contemplated in the process and apparatus of the present invention of passing a portion of the thus produced LCO/distillate via conduit means 124 to conduit 14 to be used in conjunction with the heavy naphthenic/aromatic hydrocarbon feed stream as a diluent. Additionally, the LCO in conduit 124 may also be used with intermediate nozzles (not shown) on one or both of the reactors downstream of the mix zone, to more accurately control the mix zone outlet temperature, and/or between reaction zones in the reactors to control the reactor zone temperatures.

A non-distillate heavy cycle gas oil (HCO) fraction having an initial boiling range of about 600° F. to about 670° F. is withdrawn from column 98 at an intermediate point thereof, lower than said LCO/distillate fraction draw point, via conduit means 126.

From the bottom portion of column 98, a slurry oil containing non-distillate HCO boiling material is withdrawn via conduit 132 at a temperature of about 600° F. to 700° F. A portion of said slurry oil can be passed from conduit 132 through a waste heat steam generator 134 wherein said portion of slurry oil is cooled to a temperature of about 450° F. From the waste heat steam generator 134, the cooled slurry oil flows as an additional reflux to the lower portion of column 98 along conduit 138. A second portion of the thus produced slurry oil withdrawn via conduit 136 flows as product slurry oil.

Model estimates of products from the riser reactors 8 and 108 are shown in Table III, including the product profiles from the individual reactors of the present invention and the combined product profile. Also illustrated in Table III are the comparative results from a single riser for the unsegregated feedstock.

Table IV is a second example of model estimates of the process of the present invention, likewise including the product profiles from the separate risers and the combined yield, with comparative examples of a single riser without catalyst cooling, a single riser with cat cooling and a single riser with increased cat cooling. Comparisons with cat cooling are especially relevant wherein cat cooling is the known method of dealing with high coke feeds prior to the present invention.

Table V is another comparative example of the dual reactor system disclosed herein compared with a single reactor using the same feeds. The reactors were set for maximum gasoline with catalyst cooling.

It will be apparent to those persons skilled in the art that the apparatus and process of the present invention is applicable in any combination fluidized catalytic cracking-regeneration processes employing first and second (respectively lower and higher temperature) catalyst regeneration zones. For example, in addition to the "stacked" regeneration zones described in the embodiment of the FIGURES, a "side-by-side" catalyst regeneration zone configuration may be employed herein. All patents and publications cited herein are incorporated by reference.

TABLE III

| | VGO RISER 62.62 WT % FF) | | VTB RISER (37.38 WT % FF) | | COMBINED YIELDS (PREDICTION) | |
|---|---|---|---|---|---|---|
| PRODUCT YIELDS | WT % | VOL % | WT % | VOL % | WT % | VOL % |
| H2S | 0.19 | | 0.84 | | 0.43 | |
| H2 | 0.10 | | 0.10 | | 0.10 | |
| C1 | 1.56 | | 1.88 | | 1.68 | |
| C2 | 1.32 | | 1.56 | | 1.41 | |
| C2= | 0.89 | | 1.06 | | 0.95 | |
| TOTAL H2-C2'S | 3.87 | | 4.60 | | 4.14 | |
| C3 | 1.42 | 2.45 | 0.89 | 1.70 | 1.22 | 2.19 |
| C3 | 5.64 | 9.46 | 4.72 | 8.78 | 5.29 | 9.22 |
| nC4 | 1.20 | 1.79 | 0.72 | 1.21 | 1.02 | 1.58 |
| iC4 | 3.34 | 5.20 | 1.36 | 2.34 | 2.60 | 4.20 |
| C4= | 8.73 | 12.55 | 6.78 | 10.81 | 8.00 | 11.94 |
| TOTAL C3-C4'S | 20.32 | 31.45 | 14.47 | 24.83 | 18.14 | 29.13 |
| C5-430 deg F. TBP | 54.40 | 63.50 | 36.42 | 46.63 | 47.68 | 57.60 |
| 430-680 deg F. TBP | 13.04 | 12.31 | 12.04 | 11.99 | 12.67 | 12.20 |
| 680 deg F.+ TBP | 3.80 | 3.00 | 17.50 | 15.93 | 8.92 | 7.53 |
| COKE | 4.38 | | 14.13 | | 8.02 | |
| TOTAL | 100.00 | | 100.00 | | 100.00 | |
| C3+ LIQUID YIELD | 91.57 | 110.26 | 80.43 | 99.38 | 87.40 | 106.45 |
| 430 deg F. TBP CONVERSION | 83.16 | 84.69 | 70.46 | 72.08 | 78.41 | 80.28 |
| OPERATION CONDITIONS: | | | | | | |
| RISER OUTLET TEMP, deg F. | 980 | | 1010 | | | |
| FEED PREHEAT, deg F. | 540 | | 380 | | | |
| REGENERATOR #1, deg F. | 1266 | | 1273 | | 1268 | |
| REGENERATOR #2, deg F. | 1402 | | 1403 | | 1402 | |
| CATALYST/OIL | 5.06 | | 10.16 | | 6.96 | |
| FEED RATE, BPSD | 17550 | | 9450 | | 27000 | |
| FEED API | 30.00 | | 14.15 | | 24.07 | |
| CAT COOLER DUTY, MMBTU/HR | | | | | 0 | |
| REGEN #1% COKE BURN | 67 | | 67 | | 67 | |
| CO/CO2 IN R1 | 0.55 | | 0.55 | | 0.55 | |
| FEED CCR, WT % | 0.22 | (ESTIMATE) | 13.00 | (ESTIMATE) | 5.00 | (ESTIMATE) |
| RECYCLE, BPSD | 0 | | 5386 | | 5386 | |
| RECYCLE, VOL % | 0 | | 57 | | 20 | |
| RONC | | | | | 93.0 | |

| | SINGLE RISER EST OPERATION | |
|---|---|---|
| PRODUCT YIELDS | WT % | VOL % |
| H2S | 0.43 | |
| H2 | 0.10 | |
| C1 | 1.64 | |
| C2 | 1.37 | |
| C2= | 0.93 | |
| TOTAL H2-C2'S | 4.04 | |
| C3 | 1.20 | 2.16 |
| C3 | 5.23 | 9.12 |
| nC4 | 0.95 | 1.48 |
| iC4 | 2.28 | 3.69 |
| C4= | 8.08 | 12.04 |
| TOTAL C3-C4'S | 17.74 | 28.49 |
| C5-430 deg F. TBP | 44.59 | 53.74 |
| 430-680 deg F. TBP | 13.97 | 13.71 |
| 680 deg F.+ TBP | 11.79 | 10.27 |
| COKE | 7.44 | |
| TOTAL | 100.00 | |
| C3+ LIQUID YIELD | 88.09 | 106.21 |
| 430 deg F. TBP CONVERSION | 74.24 | 76.02 |
| OPERATION CONDITIONS: | | |
| RISER OUTLET TEMP, deg F. | 990 | |
| FEED PREHEAT, deg F. | 380 | |
| REGENERATOR #1, deg F. | 1253 | |
| REGENERATOR #2, deg F. | 1383 | |
| CATALYST/OIL | 6.73 | |
| FEED RATE, BPSD | 27000 | |
| FEED API | 24.07 | |
| CAT COOLER DUTY, MMBTU/HR | 0 | |
| REGEN #1% COKE BURN | 67 | |
| CO/CO2 IN R1 | 0.55 | |
| FEED CCR, WT % | 5.00 | (ESTIMATE) |

TABLE III-continued

| | |
|---|---|
| RECYCLE, BPSD | 0 |
| RECYCLE, VOL % | 0 |
| RONC | 93.0 |

TABLE IV

| PRODUCT YIELDS | VGO RISER 68.1 WT % FF) | | VTB RISER (31.9 WT % FF) | | COMBINED YIELDS (PREDICTION) | |
|---|---|---|---|---|---|---|
| | WT % | VOL % | WT % | VOL % | WT % | VOL % |
| H2S | 0.20 | | 0.56 | | 0.31 | |
| H2 | 0.10 | | 0.10 | | 0.10 | |
| C1 | 1.61 | | 1.69 | | 1.64 | |
| C2 | 1.36 | | 1.42 | | 1.38 | |
| C2= | 0.92 | | 0.96 | | 0.93 | |
| TOTAL H2-C2'S | 3.99 | | 4.17 | | 4.05 | |
| C3 | 1.42 | 2.46 | 0.92 | 1.74 | 1.26 | 2.24 |
| C3= | 5.65 | 9.48 | 5.15 | 9.47 | 5.49 | 9.48 |
| nC4 | 1.21 | 1.81 | 0.83 | 1.36 | 1.09 | 1.68 |
| iC4 | 3.39 | 5.27 | 1.43 | 2.44 | 2.76 | 4.42 |
| C4= | 8.72 | 12.53 | 7.71 | 12.14 | 8.40 | 12.41 |
| TOTAL C3-C4'S | 20.39 | 31.55 | 16.04 | 27.15 | 19.00 | 30.23 |
| C5-445 deg F. TBP | 55.54 | 64.64 | 38.69 | 48.70 | 50.16 | 59.86 |
| 445-680 deg F. TBP | 11.41 | 10.69 | 12.40 | 12.23 | 11.73 | 11.15 |
| 680 deg F.+ TBP | 3.79 | 3.00 | 13.63 | 12.12 | 6.93 | 5.74 |
| COKE | 4.68 | | 14.51 | | 7.82 | |
| TOTAL | 100.00 | | 100.00 | | 100.00 | |
| C3+ LIQUID YIELD | 91.13 | 109.88 | 80.76 | 100.20 | 87.82 | 106.98 |
| 445 deg F. TBP CONVERSION | 84.80 | 86.31 | 73.97 | 75.65 | 81.35 | 83.11 |
| OPERATION CONDITIONS: | | | | | | |
| RISER OUTLET TEMP, deg F. | 980 | | 1015 | | | |
| FEED PREHEAT, deg F. | 440 | | 540 | | | |
| REGENERATOR #1, deg F. | 1239 | | 1234 | | 1237 | |
| REGENERATOR #2, deg F. | 1412 | | 1418 | | 1414 | |
| CATALYST/OIL | 5.50 | | 9.77 | | 6.86 | |
| FEED RATE, BPSD | 14000 | | 6000 | | 20000 | |
| FEED API | 30.00 | | 15.98 | | 25.52 | |
| CAT COOLER DUTY, MMBTU/HR | — | | — | | 0 | |
| REGEN #1% COKE BURN | 55 | | 55 | | 55 | |
| CO/CO2 IN R1 | 0.50 | | 0.50 | | 0.50 | |
| FEED CCR, WT % | 0.37 | (ESTIMATE) | 16.00 | (ESTIMATE) | 5.36 | |
| RECYCLE, BPSD | 0 | | 4200 | | 4200 | |
| RECYCLE, VOL % | 0 | | 70 | | 21 | |

| PRODUCT YIELDS | SINGLE RISER EST OPERATION | | SINGLE RISER EST OPER W/CAT COOL | | SINGLE RISER EST W/INC. CAT COOL | |
|---|---|---|---|---|---|---|
| | WT % | VOL % | WT % | VOL % | WT % | VOL % |
| H2S | 0.31 | | 0.31 | | | |
| H2 | 0.10 | | 0.10 | | | |
| C1 | 1.67 | | 1.20 | | | |
| C2 | 1.40 | | 1.02 | | | |
| C2= | 0.95 | | 0.69 | | | |
| TOTAL H2-C2'S | 4.12 | | 3.01 | | 2.9 | |
| C3 | 1.13 | 2.00 | 1.19 | 2.12 | | |
| C3= | 5.14 | 8.87 | 5.19 | 8.95 | | |
| nC4 | 0.96 | 1.48 | 0.98 | 1.52 | | |
| iC4 | 2.18 | 3.49 | 2.37 | 3.80 | | |
| C4= | 8.12 | 12.01 | 8.12 | 12.00 | | |
| TOTAL C3-C4'S | 17.53 | 27.85 | 17.85 | 28.39 | 18.0 | 28.6 |
| C5-430 deg F. TBP | 47.62 | 56.98 | 48.46 | 57.98 | 48.8 | 58.4 |
| 430-680 deg F. TBP | 13.92 | 13.54 | 13.82 | 13.42 | | |
| 680 deg F.+ TBP | 8.73 | 7.51 | 8.17 | 7.01 | | |
| COKE | 7.77 | | 8.38 | | 8.6 | |
| TOTAL | 100.00 | | 100.00 | | | |
| C3+ LIQUID YIELD | 87.80 | 105.88 | 88.30 | 106.80 | | |
| 430 deg F. TBP CONVERSION | 77.35 | 78.95 | 78.01 | 79.57 | 78.6 | 80.2 |
| OPERATION CONDITIONS: | | | | | | |
| RISER OUTLET TEMP, deg F. | 995 | | 990 | | 990 | |
| FEED PREHEAT, deg F. | 300 | | 370 | | 370 | |
| REGENERATOR #1, deg F. | 1238 | | 1158 | | 1146 | |
| REGENERATOR #2, deg F. | 1418 | | 1330 | | 1316 | |
| CATALYST/OIL | 6.76 | | 7.97 | | 8.33 | |
| FEED RATE, BPSD | 20000 | | 20000 | | 20000 | |
| FEED API | 25.52 | | 25.52 | | 25.52 | |
| CAT COOLER DUTY, MMBTU/HR | 0 | | 40 | | 48 | |
| REGEN #1% COKE BURN | 55 | | 55 | | 55 | |
| CO/CO2 IN R1 | 0.50 | | 0.40 | | | |

TABLE IV-continued

| | | |
|---|---|---|
| FEED CCR, WT % | 5.36 | 5.36 |
| RECYCLE, BPSD | 0 | 0 |
| RECYCLE, VOL % | 0 | 0 |

TABLE V

| | SINGLE RISER | | | TWO RISER | | |
|---|---|---|---|---|---|---|
| PRODUCT YIELDS | WT % | VOL % | API | WT % | VOL % | API |
| H2S | 0.16 | | | 0.16 | | |
| HS | 0.10 | | | 0.10 | | |
| C1 | 1.17 | | | 1.19 | | |
| C2 | 1.00 | | | 1.02 | | |
| C2= | 0.68 | | | 0.69 | | |
| TOTAL H2-C2'S | 2.95 | | | 3.00 | | |
| C3 | 1.19 | 2.17 | | 1.26 | 2.30 | |
| C3= | 4.73 | 8.39 | | 4.99 | 8.85 | |
| nC4 | 0.85 | 1.35 | | 0.92 | 1.46 | |
| iC4 | 2.27 | 3.73 | | 2.47 | 4.06 | |
| C4= | 7.04 | 10.69 | | 7.32 | 11.12 | |
| TOTAL C3-C4'S | 16.08 | 26.33 | 118.9 | 16.96 | 27.79 | 119.0 |
| C5-82 deg C. TBP | 14.40 | 20.11 | 82.0 | 14.50 | 20.34 | 83.0 |
| 82-190 deg C. TBP | 24.66 | 28.76 | 46.8 | 28.16 | 32.71 | 46.1 |
| 190-380 deg C. TBP | 21.34 | 21.52 | 22.7 | 19.75 | 19.70 | 21.0 |
| 380 deg C.+ TBP | 11.48 | 10.05 | 2.3 | 8.27 | 7.02 | −1.7 |
| COKE | 8.93 | | | 9.20 | | |
| TOTAL | 100.00 | | | 100.00 | | |
| C3+ LIQUID YIELD | 87.96 | 106.77 | | 87.64 | 107.56 | |
| 190 deg C. TBP CONVERSION | 67.18 | 68.43 | | 71.98 | 73.28 | |
| OPERATION CONDITIONS: | | | | | | |
| RISER OUTLET TEMP, deg C. | 527 | | | 527 | | |
| FEED PREHEAT, deg C. | 177 | | | 188 | | |
| REGENERATOR #1, deg C. | 661 | | | 667 | | |
| REGENERATOR #2, deg C. | 708 | | | 711 | | |
| CATALYST/OIL | 8.08 | | | 7.92 | | |
| FEED RATE, BPSD | 34000 | | | 34000 | | |
| FEED API | 21.4 | | | 21.4 | | |
| CAT COOLER DUTY, MMBTU/HR | 82 | | | 94 | | |
| REGEN #1% COKE BURN | 60 | | | 60 | | |
| LCO RECYCLE, BPSD | | | | 0 | | |

We claim:

1. A process for catalytically cracking a paraffin rich hydrocarbon feed comprising a vacuum gas oil portion having a K value of 12.2 or higher and a 0–6 wt % Conradson Carbon contemporaneously with a heavy feed of 4–16 wt % Conradson Carbon to produce cracked product gases comprising the steps of:

delivering regenerated catalyst to a first reactor;

delivering the paraffin rich hydrocarbon feed to the first reactor at a catalyst/oil ratio to maintain the delta coke at a level of 1.0 or less;

separating cracked product gases from spent catalyst discharging from the first reactor;

delivering at least partially regenerated catalyst to a second reactor;

delivering the heavy feed to the second reactor;

separating cracked product gases from the spent catalyst discharging from the second reactor;

passing the cracked product gases from the first and second reactors to a common line for delivery to downstream processing equipment; and passing the spent catalyst from the first and second reactors to a catalyst regeneration system.

2. A process as in claim 1 wherein the paraffin rich hydrocarbon feed has a boiling point below about 1050° F.

3. A process as in claim 2 wherein the paraffin rich hydrocarbon feed has a boiling point below about 950° F.

4. A process as in claim 1 wherein the paraffin rich hydrocarbon feed is cracked at a residence time of between 0.1 to 3 seconds and a reactor outlet temperature of from about 920° F. to about 1200° F.

5. A process as in claim 4 wherein the heavy feed is cracked at a residence time of from 0.5 to 4 seconds and a reactor outlet temperature of from about 950° F. to about 1100° F.

6. A process as in claim 5 wherein the catalyst and feed are introduced in a catalyst-to-oil ratio in the first reactor of between 3 and 8 and a catalyst-to-oil ratio in the second reactor of between 5 and 12.

7. A process as in claim 6 wherein the feed to the first reactor is introduced at a feed rate of 1 and the relative feed rate to the second reactor is 0.5 to 1.5.

8. A process as defined in claim 1 wherein the catalyst regeneration system comprises a system having a first stage and a second stage wherein the catalyst is partially regenerated in the first stage and the partially regenerated catalyst from the first stage is passed to the second stage where it is fully regenerated.

9. A process as in claim 8 further comprising the step of delivering partially regenerated catalyst from the first stage of the regeneration system to the second reactor in which heavy feed is cracked.

10. A process as in claim 9 wherein the partially regenerated catalyst is from about 40 to about 80 percent regenerated in the first stage of the catalyst regeneration system.

11. A process as in claim 8 wherein the catalyst delivered to the second reactor is fully regenerated, being taken from the second stage of the regeneration system.

12. A process as in claim 1 wherein the paraffin rich feed and the heavy feed are produced from a single source feed and comprising the further step of separating the single source feed into its paraffinic and heavy components in a vacuum tower.

13. A process as defined in claim 12 wherein the paraffin rich feed is a full atmospheric tower bottom.

14. A process as in claim 12 wherein the paraffin rich feed is the vacuum tower fraction boiling below a temperature between about 950° F. and 1050° F. and the heavy feed is the vacuum tower fraction boiling above the same temperature.

15. A process as in claim 12 wherein the paraffin rich feed is the vacuum tower fraction boiling below 1050° F. and the heavy feed is the vacuum tower fraction boiling above 1050° F.

16. A process as in claim 12 wherein the paraffin rich feed is the vacuum tower fraction boiling below about 950° F. and the heavy feed is the vacuum tower fraction boiling above 950° F.

17. A process as in claim 8 wherein the catalyst regeneration system is run under the following process conditions: a first stage regeneration temperature of less than 1300° F. to form a carbon monoxide rich first regeneration flue gas and a second regeneration zone temperature of from about 1300° F. to about 1600° F. to form a $CO_2$ rich second regeneration flue gas.

18. A process as in claim 1 wherein the following conditions are present in the first reactor: a residence time of from about 0.1 to about 3 seconds, a reactor outlet temperature of from about 920° F. to about 1200° F. and a catalyst-to-oil ratio of from about 3 to about 8 and further wherein the following conditions are present in the second reactor: a residence time of from about 0.5 to about 4 seconds, a reactor outlet temperature of from about 950° F. to about 1100° F. and a catalyst-to-oil ratio of from about 5 to about 12.

19. A process as in claim 18 wherein the residence time in the first reactor is from about 0.5 to about 2 seconds and the residence time in the second reactor is from about 1 to about 2 seconds.

20. A process as in claim 1 further comprising the step of delivering the cracked product gases and catalyst from the first and second reactors to a common conduit before separation of the catalyst from the cracked product gases.

21. A process for catalytically cracking a paraffin rich hydrocarbon feed having a vacuum gas oil portion with a K value of 12.2 or higher and a 0–6 wt % Conradson Carbon contemporaneously with a heavy feed of 4–16 wt % Conradson Carbon to produce cracked product gases comprising the steps of:

delivering regenerated catalyst to a mix zone of a first reactor;

delivering a paraffin rich hydrocarbon feed to the mix zone of the first reactor;

delivering a vaporized heavy feed to the first reactor;

separating the cracked product gases from the processing catalyst discharging from the first reactor;

delivering the processing catalyst from the first reactor to a mix zone of a second reactor;

introducing a liquid heavy feed to the mix zone of the second reactor;

separating the vaporized heavy feed and spent catalyst discharging from the second reactor;

passing the spent catalyst to a regeneration zone; and passing the vaporized heavy feed from the second reactor to the first reactor.

22. A process as defined in claim 21 where the following conditions are present in the first reactor: a residence time of from about 0.1 to about 3 seconds, a reactor outlet temperature of from about 920° F. to about 1200° F. and a catalyst-to-oil ratio of from about 8 to about 3 and further wherein the following conditions are present in the second reactor: a residence time of from about 0.2 to about 0.5 seconds, a reactor outlet temperature of from about 950° F. to about 1050° F. and a catalyst-to-oil ratio of from about 4 to about 10.

23. A process for catalytically cracking a paraffin rich hydrocarbon feed comprising a vacuum gas oil portion having a K value of 12.2 or higher and a 0–6 wt % Conradson Carbon contemporaneously with a heavy feed of 4–16 wt % Conradson Carbon to produce cracked product gases, said process consisting essentially of:

delivering regenerated catalyst to a first reactor;

delivering the paraffin rich hydrocarbon feed to the first reactor at a catalyst/oil ratio to maintain the delta coke at a level of 1.0 or less;

separating cracked product gases from spent catalyst discharging from the first reactor;

delivering at least partially regenerated catalyst to a second reactor;

delivering the heavy feed to the second reactor;

separating cracked product gases from the spent catalyst discharging from the second reactor;

passing the cracked product gases from the first and second reactors to a common line for delivery to downstream processing equipment; and passing the spent catalyst from the first and second reactors to a catalyst regeneration system.

* * * * *